US007987998B1

(12) United States Patent
Belk et al.

(10) Patent No.: US 7,987,998 B1
(45) Date of Patent: Aug. 2, 2011

(54) METHOD AND APPARATUS FOR MARKETING GREETING CARDS IN DISPLAY FIXTURES

(75) Inventors: Cathy Belk, Shaker Heights, OH (US); Jeffrey Weiss, Beachwood, OH (US); Thomas H. Johnston, Cleveland, OH (US); Steven Willensky, Gates Mills, OH (US)

(73) Assignee: American Greetings Corporation, Cleveland, OH (US)

( * ) Notice: Subject to any disclaimer, the term of this patent is extended or adjusted under 35 U.S.C. 154(b) by 699 days.

(21) Appl. No.: 11/509,359

(22) Filed: Aug. 24, 2006

Related U.S. Application Data

(60) Provisional application No. 60/759,685, filed on Jan. 17, 2006.

(51) Int. Cl.
*A47F 7/14* (2006.01)

(52) U.S. Cl. ..... 211/55

(58) Field of Classification Search ..... 211/55, 211/52, 128.1, 45, 50; 40/122; D6/459; 312/183, 34.1
See application file for complete search history.

(56) References Cited

U.S. PATENT DOCUMENTS

| | | | | |
|---|---|---|---|---|
| 320,949 | A | 6/1885 | McElroy | |
| 1,556,514 | A * | 10/1925 | Feldman | 211/55 |
| 1,672,633 | A * | 6/1928 | Vogel | 211/55 |
| 1,881,212 | A | 10/1932 | McKelvey | |
| 2,002,128 | A * | 5/1935 | Reidenbaugh | 211/1 |
| 2,067,051 | A | 1/1937 | Hall | |
| 2,333,717 | A | 9/1943 | Heed et al. | |
| 2,791,048 | A | 5/1957 | Caller | |
| 2,943,742 | A * | 7/1960 | Colley | 211/59.2 |
| 3,055,507 | A | 9/1962 | Kobs | |
| 3,302,797 | A | 2/1967 | Kolster | |
| 3,741,617 | A | 6/1973 | Gloyd | |
| 3,777,897 | A | 12/1973 | Gray | |
| 3,821,538 | A | 6/1974 | Jonathan et al. | |
| 3,838,266 | A | 9/1974 | Jonathan | |
| 3,886,348 | A | 5/1975 | Jonathan et al. | |

(Continued)

FOREIGN PATENT DOCUMENTS

EP 0198477 10/1986

OTHER PUBLICATIONS

"In Store Display".

*Primary Examiner* — Sarah Purol
(74) *Attorney, Agent, or Firm* — King & Spalding LLP

(57) ABSTRACT

A greeting card display includes an upper tier and a lower tier positioned below the upper tier. The upper and lower tiers include multiple rows of pockets for displaying greeting cards. The pockets of the upper tier typically present greeting cards in a full-facing manner to display the full face of each greeting card. The pockets of the lower tier typically present greeting cards in a partial-facing manner. The upper tier can include a card highlighter positioned along one of the rows of pockets and having pockets to present and highlight cards placed therein. Shadowboxes capable of displaying a greeting card in a full-facing manner can be positioned above the upper tier on the display and are designed to attract the attention of the consumer. A display panel, designed to evoke emotions associated with greeting cards in the shadowboxes, can be positioned between one or more of the shadowboxes.

38 Claims, 17 Drawing Sheets

U.S. PATENT DOCUMENTS 3,892,450 A 7/1975 Kolster et al.
3,908,830 A * 9/1975 Skrzelowski ..... 211/55
3,983,649 A * 10/1976 Ellis et al. ..... 40/122
D265,024 S 6/1982 Johnson et al.
4,460,097 A 7/1984 Darnell, II et al.
4,613,047 A * 9/1986 Bushyhead et al. ..... 211/55
4,621,878 A 11/1986 Johnson et al.
4,655,353 A 4/1987 Johnson et al.
4,744,473 A 5/1988 Hardy
D296,283 S 6/1988 Hardy
4,905,845 A 3/1990 Broeker et al.
4,925,038 A * 5/1990 Gajewski ..... 211/59.2
4,949,849 A 8/1990 Hardy
D332,883 S 2/1993 Staude
D351,076 S 10/1994 Eliadis et al.
D370,140 S 5/1996 Gaietto
5,620,103 A 4/1997 Vlah et al.
5,720,396 A 2/1998 Wegscheid et al.
5,758,781 A * 6/1998 Lord et al. ..... 211/55
5,915,571 A * 6/1999 Czalkiewicz et al. ..... 211/55
D412,253 S 7/1999 Brozak, Jr.
5,938,048 A * 8/1999 Carroll et al. ..... 211/55
6,068,139 A 5/2000 Brozak, Jr.
D430,758 S * 9/2000 Skrzelowksi ..... D6/478
6,170,674 B1 1/2001 Caterinacci
6,336,564 B1 * 1/2002 Garnier ..... 211/162
6,427,853 B2 8/2002 Brozak, Jr.
6,431,371 B1 8/2002 Tonon
6,530,485 B1 * 3/2003 Weber ..... 211/55
D497,269 S 10/2004 Richardson et al.
D497,495 S 10/2004 Richardson et al.
D530,940 S * 10/2006 Raile ..... D6/479
D537,274 S * 2/2007 Pirro et al. ..... D6/459
2001/0025823 A1 * 10/2001 Brozak ..... 211/55
2007/0170126 A1 * 7/2007 Singer et al. ..... 211/55
2008/0078728 A1 * 4/2008 Hodge ..... 211/55

* cited by examiner

METHOD AND APPARATUS FOR MARKETING GREETING CARDS IN DISPLAY FIXTURES

STATEMENT OF RELATED PATENT APPLICATION

This non-provisional patent application claims priority under 35 U.S.C. §119 to U.S. Provisional Patent Application No. 60/759,685, titled Method and Apparatus For Increasing Greeting Card Sales, filed Jan. 17, 2006. This provisional application is hereby fully incorporated herein by reference.

FIELD OF THE INVENTION

This invention relates to display racks or assemblies for displaying merchandise, such as greeting cards. More specifically, the invention assists consumers in distinguishing between groups of greeting cards based on the manner of presentation in a multi-tiered greeting card display.

BACKGROUND OF THE INVENTION

As consumer's day-to-day lives get busier and as other options for maintaining contact with friends and family have arisen, such as e-mail, consumer's have less time and may feel less obligated to purchase greeting cards for all but the most important occasions. Conventional greeting card displays typically include cascading rows of pockets that display greeting cards in a manner that allows only a portion of the front of each card to be seen. While this type of display makes a large number of cards accessible to consumers, it can make the process of purchasing a greeting card more time consuming and difficult. For example, a consumer has to remove each greeting card from its pocket to determine if he or she would like to read the message on the inside of the card.

In addition, since all of the cards are typically presented by a conventional card display in the same manner, there are no visual cues alerting the consumer to cards that are trendy, represent emerging trends, or worthy of closer review. While those cards may be on display, the consumer must "hunt and peck" to find them. In addition, while most conventional card displays include caption cards or tabs that identify the occasion associated with the greeting card in that pocket, these tabs are generally presented with the same color background and text for all occasions. The lack of color coordination by greeting card occasion makes it difficult to distinguish between "Birthday" cards and "Wedding" cards without having to constantly look at a display panel at the top of the fixture for guidance. Then, when the consumer looks back down, he or she is once again lost in a sea of greeting cards.

Therefore, there is a need in the art for a display that (1) efficiently displays the product; (2) draws the consumer's attention to the product, thereby inducing impulse purchases; and (3) makes the card buying process easier and less time consuming.

SUMMARY OF THE INVENTION

The present invention provides methods and fixtures for organizing greeting cards into particularized groupings and displaying the greeting cards on those fixtures in a manner that attracts the attention of the consumer and makes the card purchasing process more convenient and less time consuming.

A greeting card display fixture is typically positioned in a card retail area. The display fixture can be modular and additional display fixtures can be easily attached to the sides thereof to create a fixture that has a longer aisle length. The display fixture can include an upper tier, a lower tier, and framework to hold the tiers in place. Both the upper tier and the lower tier comprise rows of pockets that are capable of displaying greeting cards. The rows and pockets of the upper tier are typically designed to display greeting cards in a full-facing manner. When a card is presented in a full-facing manner, all or substantially all of the front of the greeting card can be viewed without having to remove the card from the pocket. The rows and pockets of the lower tier can be designed to display greeting cards in a partial-facing manner, such that only a portion of the front of a greeting card can be viewed while the card is in the pocket.

A visual relief line (or caption strip) can be positioned between the upper and lower tiers. The visual relief line emphasizes the separation between the upper and lower tiers to the consumer and provides a momentary break or rest for the eyes of the consumer as they scan over the entire fixture. The visual relief line can take the form of a structure between the upper and lower tiers or a void or gap between the upper and lower tiers.

Shadowboxes can be positioned along the top of the upper tier of the display fixture. Shadowboxes are used to "telegraph" a card occasion and to deliver specific occasion insights. This is accomplished by placing cards inside the shadowboxes that are readily recognizable by a consumer as being related to a particular occasion, without a need for the consumer to read the card. A display panel can be positioned between one or more of the shadowboxes along the top of the upper tier of the display fixture. The display panel typically includes pictures, graphics, colors, and/or text associated with the cards displayed in the shadowboxes and intended to evoke emotions from the consumer.

Both the upper and lower tiers can also include card highlighters positioned along one of the rows of pockets. Each of the card highlighters is capable of displaying cards in a full-facing or partial-facing manner. The consumer's eye is attracted to the card highlighters because they have a different "look" from the rest of the greeting cards in the display fixture.

For one aspect of the present invention, the greeting card display fixture can include an upper tier display and a lower tier display. The upper tier display is typically positioned at eye-level for the average consumer of greeting cards. The lower tier display can be positioned below the upper tier display. Both the upper and lower tier displays typically include rows of pockets for displaying greeting cards. The rows and pockets of the upper tier display are designed so that cards displayed in the upper tier can be displayed in a full-facing manner. The rows and pockets of the lower tier display are designed so that cards displayed in the lower tier can be displayed in a partial-facing manner, so that only a portion of the front of each card is viewable when it is in the pocket. By presenting cards with a different manner of facing in the upper and lower tiers, the consumer is provided with a visual cue that there is a distinction between the cards displayed in the upper tier versus the cards displayed in the lower tier. The fixture can also include a card highlighter positioned along one of the rows of the upper tier. The card highlighter is typically designed to attract the consumer's eye to cards displayed in a full-facing manner within the highlighter to generate an impulsive purchase.

For another aspect of the present invention, the greeting card display can include a display fixture and an endcap display. The display fixture can include an upper and lower tier that each include pockets for displaying greeting cards.

The upper tier can further include a card highlighter positioned along one of the rows of the upper tier. The endcap display can be positioned along one or both ends of the display fixture. The endcap display typically includes a front display panel that includes rows of pockets that can display cards in a full-facing manner. The endcap display can also include one or more side display panels that can be attached to the back side of the front display panel. Each side display panel can have rows of pockets that display greeting cards in a full-facing manner. The side panels can be positioned in-line with the display fixture, while the front display panel typically extends perpendicular to the display fixture. A barrier can be positioned between the display fixture and the side panels to provide a visual cue to consumers that they are transitioning from the display fixture to the end cap display.

For another aspect of the present invention, a method of marketing greeting cards comprises organizing greeting cards into three groups for presentation on a display based on card characteristics, such as the trendiness of the card and the card's past sales history. The method also can include positioning a greeting card display fixture having an upper tier and a lower tier, each with multiple rows of pockets, in a card retail area. The first group of cards can include A-SKU level cards that are trendier and more likely to be cutting edge. The first group of cards can be displayed in a card highlighter positioned along one of the rows in the upper tier of the display fixture. The second group of cards can include B-SKU level cards that are typically not as trendy as A-SKU level cards but do highlight emerging trends. The second group of cards can be displayed in a full-facing manner in the pockets of the upper tier of the display fixture. The third group of cards can include C-SKU level cards, which have a strong sales history. The third group of cards can be displayed in a partial-facing manner in the rows of pockets in the lower tier of the display fixture.

For yet another aspect of the present invention, a method of marketing greeting cards comprises organizing an inventory of greeting cards for an occasion into three groups and displayed as described above. The method can further include, positioning an occasion display panel above the upper tier of the display fixture designating the greeting card occasion associated with the cards in the display fixture. In addition, colors can be assigned to each greeting card occasion and the color associated with the occasion display panel can be applied to the display panel to assist consumers in locating the occasion for which they want to purchase a greeting card. Caption cards that identify the occasion or sub-occasion for a greeting card can be provided in the pockets of the upper and lower tiers. For example, for cards organized into the second and third groups, a lighter shade of the color associated with the occasion can be applied to the caption cards in the pockets presenting the second and third group of greeting cards. For cards organized into the first group, a complimentary color can be selected and applied to caption cards in the pockets presenting the first group of greeting cards.

For another aspect of the present invention, a method of displaying greeting cards can comprise displaying a portion of the greeting cards in the upper tier of a greeting card display in a full facing manner. The method can also include displaying another portion of the greeting cards in a lower tier of the greeting card display. The cards in the lower tier can be displayed in a manner other than full-facing. In addition, the method can include positioning a card highlighter display along a row of the upper tier of the greeting card display. Furthermore, greeting cards can be placed within pockets of the card highlighter to highlight those cards in the greeting card display.

BRIEF DESCRIPTION OF THE DRAWINGS

For a more complete understanding of exemplary embodiments of the present invention and the advantages thereof, reference is now made to the following description in conjunction with the accompanying drawings in which.

DETAILED DESCRIPTION OF THE EXEMPLARY EMBODIMENTS

I. Fixtures

Figure 1:
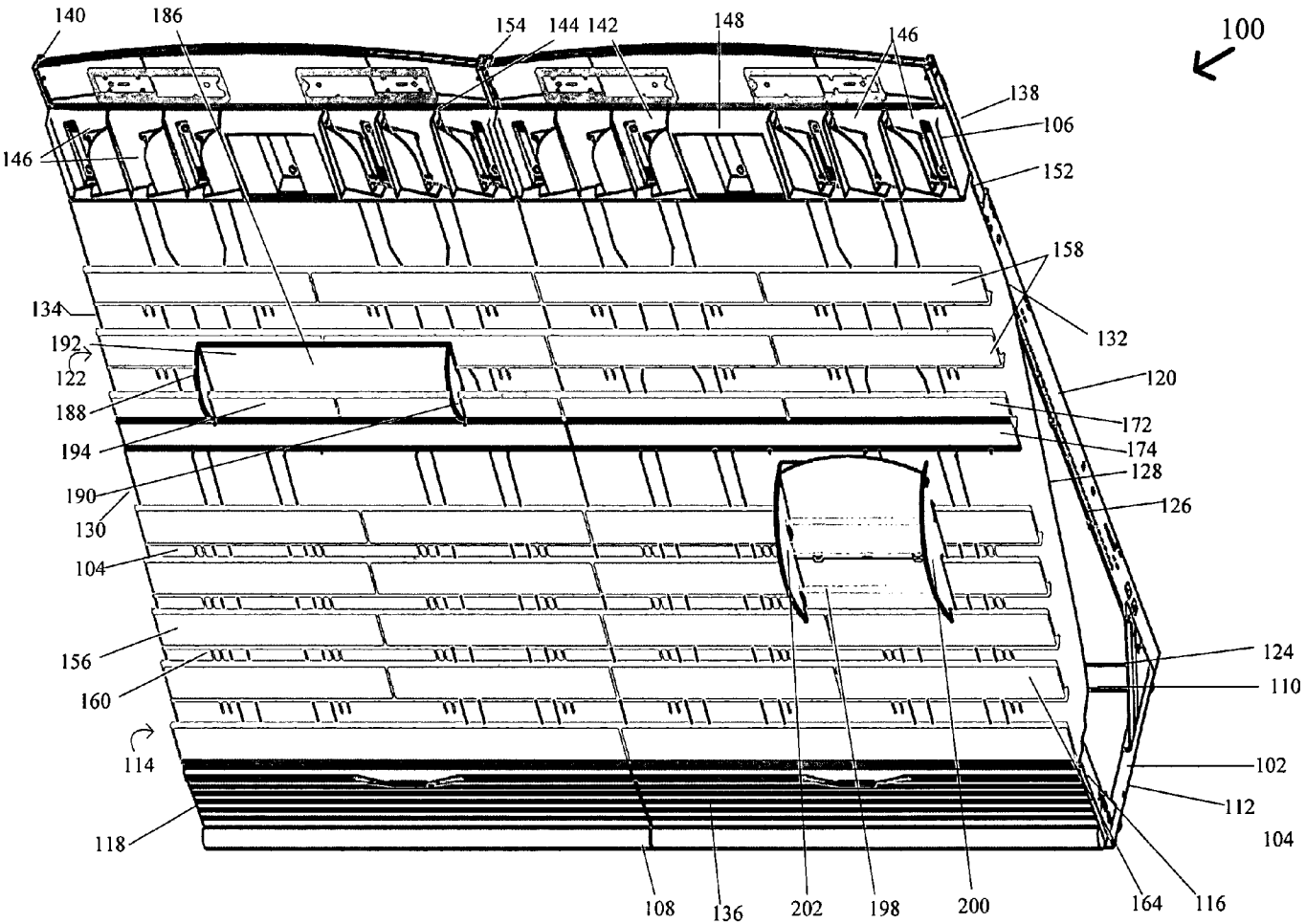
FIG. 1 illustrates a card display rack according to one exemplary embodiment of the present invention.

Exemplary embodiments of the invention will now be described in detail with reference to the figures. While the fixtures of the present invention are described in the context of an operative environment used for the display of greeting cards in the retail arena, those of ordinary skill in the art will recognize that the fixtures can be used in a like-manner for other types of products. Referring now to FIG. 1, detailed drawings of an adjustable display assembly 100 according to an exemplary embodiment of the present invention is described. The adjustable display assembly 100 of FIG. 1 includes a framing assembly 102, a display rack 104 and multiple shadowboxes 106.

A. Framing Assembly

Turning now to the framing assembly 102 of FIG. 1, the framing assembly 102 includes a first horizontal member 108 and a second horizontal member 110 in parallel to one another. The first horizontal member 108 and second horizontal member 110 are each attached orthogonally at a first end to a third horizontal member 112. The first horizontal member 108 and second horizontal member 110 are each attached orthogonally at the opposing end to a fourth horizontal member 114. The attachment of the first 108, second 110, third 112, and fourth 114 horizontal members creates a base having a substantially rectangular shape. This rectangular shape or base may rest upon a floor or platform. The rectangular base provides a base for the remainder of the display rack 104. In one exemplary embodiment, the first 108 and second 110 horizontal members and the display rack 104 have a length of 48.084 inches. The exemplary third 112 and fourth 114 horizontal members have a length of 18.014 inches.

Attached orthogonally to the first 108 and third 112 horizontal members is a first vertical member 116 that rises upward in the vertical direction from the base. Attached orthogonally to the first 108 and fourth 114 horizontal members is a second vertical member 118 rising vertically upward from the base. The first 116 and second 118 vertical members are substantially parallel to one another. Attached orthogonally to the second 110 and third 112 horizontal members is a third vertical member 120 rising vertically upward from the base. Attached orthogonally to the second 110 and fourth 114 horizontal members is a fourth vertical member 122 (not shown) rising upward in the vertical direction from the base. The first 116, second 118, third 120, and fourth 122 vertical members are substantially parallel to one another. In one exemplary embodiment, the third 120 and fourth 122 vertical members extend vertically to a height of 59.328 inches.

In one exemplary embodiment, a fifth horizontal member 124, substantially parallel to the second horizontal member 110, is orthogonally attached at each end to the third vertical member 120 and the fourth vertical member 122 (not shown). The fifth horizontal member 124 can provide improved strength and durability to the framing system. In one exemplary embodiment, the third vertical member 120 and the fourth vertical member 122 each includes multiple slots 126 running in the vertical direction of the third 120 and fourth 122 vertical members along a point of contact with a first angled member 128 and a second angled member 130. The slots (not shown) in the third 120 and fourth 122 vertical members may be spaced a uniform distance apart or comparatively close together so that the angled members may be adjusted vertically along the axis of the third and fourth vertical members 122. This provides the ability to position the display rack 104 at a range of desired heights.

Each of the first 128 and second 130 angled members has a substantially vertical portion 132, 134 at its uppermost point that remains in contact or substantially in contact with the third vertical member 120 and the fourth vertical member 122 (not shown). Approximately one-third of the way along the length of the first 128 and second 130 angled members, each angled member diverges from the third 120 and fourth 122 vertical members in a substantially straight line to connect with the first 116 and second 118 (not shown) vertical members, respectively.

B. Card Display Rack

A graphics display holder 136 may be attached at or near the bottom of the first 128 and second 130 angled members and run substantially parallel to the first horizontal member 108. The graphics display holder 136 may be attached on a first end to the first vertical member 116 and on a second end to the second vertical member 118. In one exemplary embodiment, the graphics display holder 136 includes receptacles (not shown) at the top and bottom to hold a graphic made of paper, cardboard, card stock, metal or plastic. The graphic may be slidably inserted from the side of the graphics display holder 136 or snapped into the front of graphics display holder 136.

1. Shadowboxes

A fifth vertical member 138 may be attached at or near the top of the third vertical member 120 and extend further upward in the vertical direction, parallel to the third vertical member 120. A sixth vertical member 140 may be attached at or near the top of the fourth vertical member 122 and extend upward therefrom in the vertical direction, substantially parallel to the fourth vertical member 122. One or more shadowbox displays 142, 144 may be attached at each opposing end to the fifth 138 and sixth 140 vertical members. In one exemplary embodiment, the fifth 138 and sixth 140 vertical members extend to a height of 69.419 inches and have an individual length of 10.091 inches. In an alternative embodiment, the fifth 138 and sixth 140 vertical members extend to a height of 71.457 inches and have an individual length of 12.129 inches. Each shadowbox display 142, 144 typically includes one or more shadowbox card display holders 146 and a graphics display panel 148. In one exemplary embodiment, each shadowbox display 142, 144 has a width of 15.86 inches and a height of 10.091 inches. The exemplary graphics display panel 148 has a width of sixteen and one-eighth inches. The shadowboxes 146 are used to "telegraph" a card occasion and to deliver on specific occasion insights. This is accomplished by placing cards inside the shadowboxes 146 that are readily recognizable by a consumer as being related to a particular occasion, without a need for the consumer to read the card. In one exemplary embodiment, matched pairs of cards are presented in a shadowbox card display holder 146, on each side of the graphics display panel 148. The matched pairs set the tone of the card occasion for the consumer and generate an emotional appeal on behalf of the consumer. Each of the cards displayed in the shadowboxes 146 are associated with the card category identified by graphics display panel 148. While the drawing of FIG. 1 describes an embodiment having two shadowbox card display holders 146 on each side of the graphics display panel 148, in an alternative exemplary embodiment, three shadowbox card display holders 146 are positioned on each side of the graphics display panel 148.

The shadowbox display 142, 144, as shown in FIG. 1, typically includes multiple substantially rectangular segments on each opposing side of a dome-shaped graphics display panel 148. Each rectangular segment may include one or more substantially rectangular cut-outs 150. The longer sides of the rectangular cut-out 150 are positioned on the vertical axis of the rectangular segment, substantially parallel to the vertical members 116, 120 of the framing assembly 102. In one exemplary embodiment, the cut-outs in the rectangular segments can include a filler substance (not shown) that allows a card placed into the cut-out to face inward and toward the graphics display panel 148. In the exemplary embodiment, C-SKU level cards are displayed in the shadowboxes 146. In an alternative embodiment, the shadowboxes 146 display B-SKU level cards.

Figure 8:
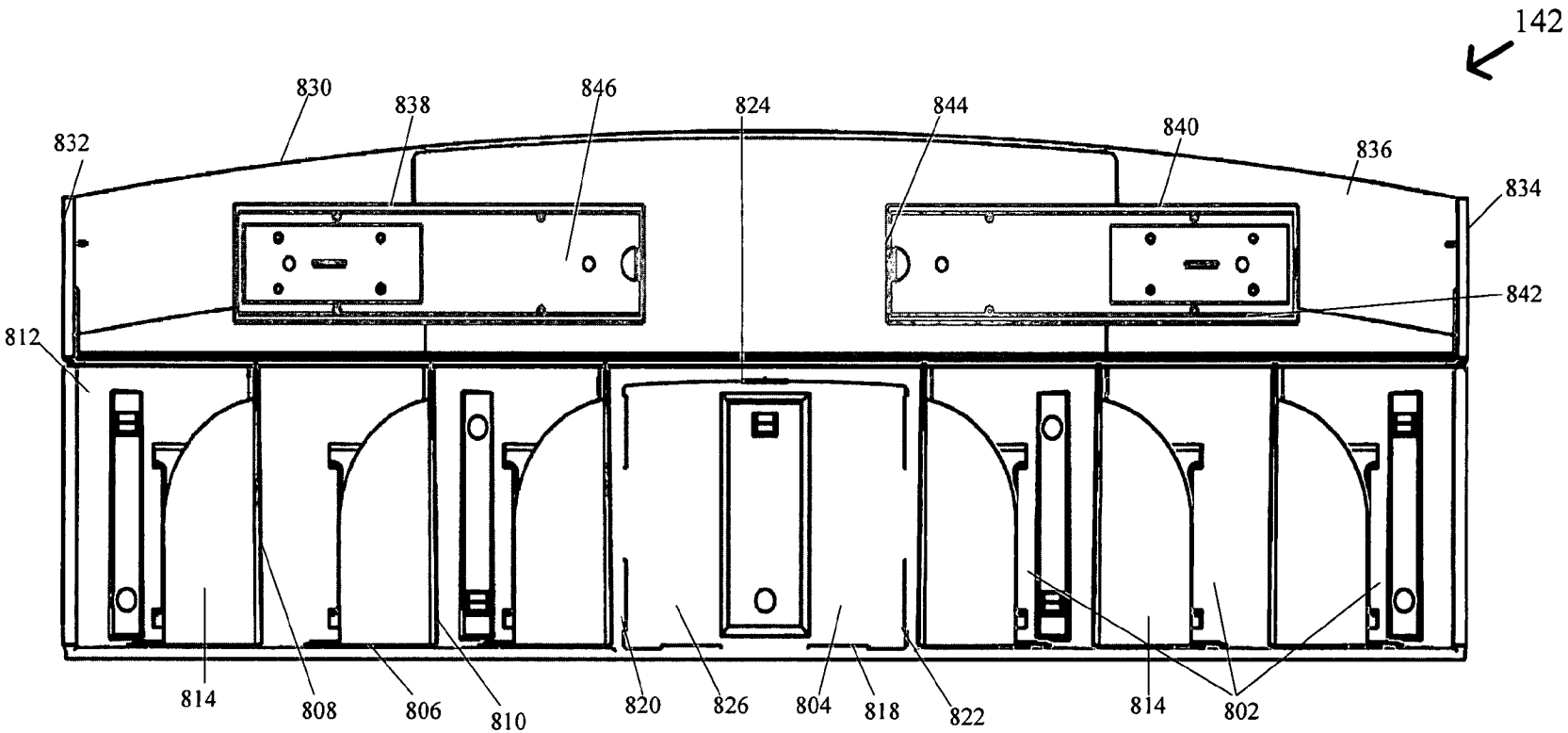
FIG. 8 illustrates shadowboxes for the exemplary card display rack of FIG. 1.

FIG. 8 provides a detailed drawing of an alternative embodiment of the shadowbox display 142 of FIG. 1. Now referring to FIG. 8, the alternative shadowbox display 142 includes three alternative shadowboxes 802 on each side of an alternative graphics display panel 804. Each shadowbox 802 includes a bottom member 806 orthogonally attached to a left member 808 and a right member 810. The left 808 and right 810 members extend upward in the vertical direction from the bottom member 806. The shadowbox 802 further includes a back member 812 orthogonally attached to the back sides of the bottom 806, left 808, and right 810 members. The bottom 806, left 808, right 810, and back 812 members are typically made of metal, wood, or plastic.

A front member 814 is orthogonally attached to the left 808 or right 810 members. The front member 814 typically extends in the vertical direction from the bottom of the left 808 or right 810 member to a height approximately equal to half the height of the member. The front member 814 also extends in the horizontal direction along the bottom member 806 a distance approximately equal to half the length of the bottom member 806. The front member 814 typically extends in an arc from its highest point to the point at which it extends furthest along the bottom member 806. In one exemplary embodiment, the front member 814 is made of a clear material, such as acrylic or plastic. The bottom 806, left 808, right 810, front 814, and back 812 members are typically attached using well-known attachment methods and form a pocket having a depth of approximately one inch. The pocket is generally capable of holding and displaying one or more cards in a full-faced manner.

The shadowboxes 802 contain an assortment of cards that telegraph the occasion. These full-facing cards telegraph the occasion because the ordinary consumer can determine the occasion of the card by viewing the graphics on the front of the card in the shadowbox 802 and will not need to look-up at the marquee display panel 836. The cards in the shadowboxes 802 are sometimes in matched pairs, one on each side of the graphic display panel 148, each having the same graphic design on the front of the card but typically meant for the opposite sex (i.e. birthday for her and birthday for him). The presentation of greeting cards in the shadowboxes 802 provides an opportunity to stir additional emotional feelings, thereby increasing the opportunity for a sale to a consumer.

The alternative shadowbox display 142 further includes an alternative graphics display panel 804. The graphics display panel 804 includes a substantially horizontal bottom member 818 orthogonally attached to a substantially vertical left member 820 and right member 822. The left 820 and right 822 members are substantially parallel to one another and orthogonally attached on the other end to a horizontal top member 824. The top member 824 is substantially parallel to the bottom member 818. The attachment of the bottom 818, top 824, left 820, and right 822 members creates a substantially square box. The graphics display panel 804 further includes a substantially square graphic 826 capable of being slidably inserted, or snapped, into the graphics display panel 804. The graphic typically includes pictures, graphics, colors, and/or text associated with the cards displayed in the assembly 100 and intended to evoke emotions from the consumer.

Returning to FIG. 1, a sixth horizontal member 152, running substantially in the same direction as the first 108 and second 110 horizontal members, is orthogonally attached to the uppermost portion of the first 128 and second 130 angled member, creating a top rail for the display rack 104. The shadowbox card displays 142, 144, as described earlier, are attached to the sixth horizontal member 152. In one exemplary embodiment, a seventh vertical member 154 may be orthogonally attached to the sixth horizontal member 152 at the intersection of two shadowbox displays 142, 144, allowing the opposing ends of each of the shadowbox displays 142, 144 to be attached to the seventh vertical member 154.

2. Card Display Rack

The card display rack 104 in FIG. 1 includes a first group of pockets 156 that extends substantially in the horizontal direction from the first angled member 128 to the second angled member 130. The pockets 156 are organized to extend in the vertical direction to a caption strip 174. The card display rack 104 can also include a second group of pockets 158 that extend substantially in the horizontal direction from the first angled member 128, on one side of each pocket, to the second angled member 130 at the opposing end of the pocket. The pockets 158 extend upward in a cascade-like manner to the sixth horizontal member 152.

The first 156 and second 158 groups of pockets typically include steeply sloping, (and optionally vertical) back members 160 (not shown), gently sloping, (and optionally horizontal) bottom members 162 (not shown), and a steeply sloping (and optionally vertical) front member 164 (not shown). The back members 160, bottom members 162, and front member 164 together form compartments or pockets 166 for greeting cards extending in a cascade-like manner. The single steeply sloping front member 164 typically extends upwardly from the front edge of the lowermost bottom member 162 of the first 156 and second 158 group of pockets. The single steeply sloping front member 164 can be positioned parallel or substantially parallel to the back member 160, typically at a height less than that of the back member. Corresponding side edges of the back 160, bottom 162, and front 164 members are aligned so that they lie in a common plane. Each of the back members 160, except for the back member for the highest row 168 (not shown), forms the front for a half pocket and the back for the half pocket immediately below. The first angled member 128 on one side and the second angled member 130 on the other side form a common side wall for all of the pockets. Each of the bottom members 162 and back members 160 immediately thereabove may be formed from a single sheet of metal, plastic wood, or other material known to those of ordinary skill in the art. Similarly the front member 164, the lowermost bottom member 162, and the lowermost back member 160 may be formed from a single sheet. Each of the bottom members 162 may be attached to the back member 160 along the front edge of the bottom member 162. Alternatively, each of these members may be integrally molded from a single or multiple plastic materials. On the side of each of the pockets (not visible in FIG. 1) are means for attaching the pockets to the first 128 and second 130 angled members. In one exemplary embodiment, the vertical distance from the bottom of the front member 164 to the top of the shadowboxes 146 is 58.479 inches.

In another exemplary embodiment, horizontal members 170 (not shown) are attached at one end to the first angled member 128 and at an opposing end to the second angled member 130. The horizontal members 170 are spaced vertically along the length of the first 128 and second 130 angled members and provide a means (not shown) for attaching card pockets 166 to form the card display rack 104. The space between the first angled member 128 and the second angled member 130 forms multiple pockets 166 attached to the horizontal members 170 in a side-by-side manner to create a row. Each of the pockets 166 may be attached to one of the horizontal members 170 (not shown) by means of tabs (not shown) or other methods known to those of ordinary skill in the art. The bottom row of the pockets 166 can further include a front member 164 made of a clear material, such as plastic, so that the entire front of the greeting card placed in a pocket may be viewed by a consumer. The first row of pockets 172, positioned above the caption strip 174, typically has a front member 164 that is made of a clear material, such as plastic. Cards in each individual display rack 104 are typically associated with the same category. Each category may also have several subcategories of cards displayed on the rack 104 under that category. For example, a rack 104 of cards under the category "Birthday" may include subcategories of cards in that particular rack 104 such as, "his birthday," "her birthday," "wife's birthday," etc. Each card may belong to one or more subcategories within a category. For example, a birthday card for a "wife" would fall under the subcategory "wife's birthday" and "her birthday." Each of these subcategories can be presented on the same display rack 104.

3. A-SKU Highlighters

The card display rack 104 may include a curved A-SKU card highlighter holder 178 (not shown). The holder 178 highlights A-SKU level cards. These A-SKU level cards typically represent a trendy card design that is more likely to generate an impulse buy. By placing them in the highlighter, the consumer's eye is attracted to the A-SKU level cards because they have a different "look" from the rest of the display rack 104. The holder 178 is typically positioned on the row immediately above the caption strip 174 to improve the likelihood that a consumer will see it. Cards in the row immediately above the caption strip 174 have an better opportunity to attract the consumers attention because the consumer's eyes are drawn to towards the caption strip due to it being different that the rest of the display rack 104. The consumer's attention is further attracted towards the highlighter 178 because it presents cards in a different manner that the rest of the display rack 104. The holder 178 includes a convex clear plastic or metallic front 180 (not shown), a curved bottom member (not shown) and a convex back member (not shown) that is curved so that the cards extend outward from the remaining part of the card display rack 104. Each end 182, 184 (not shown) of the holder 178 is positioned substantially even with the pockets of a row and the center point of the curved card highlighter holder 178 extends outward from the card display rack 104.

A metallic, wood, or hard plastic bracing arm (not shown) may be placed behind the curved card highlighter holder 178, providing additional support for cards placed within the holder. The curved highlighter holder 178 may be slidably inserted into the sham of multiple pockets 166. In this manner, the curved card highlighter holder 178 can be inserted into the sham of and take the place of one or more pockets 166 in the first row 172 above the caption strip 174.

Figure 2:
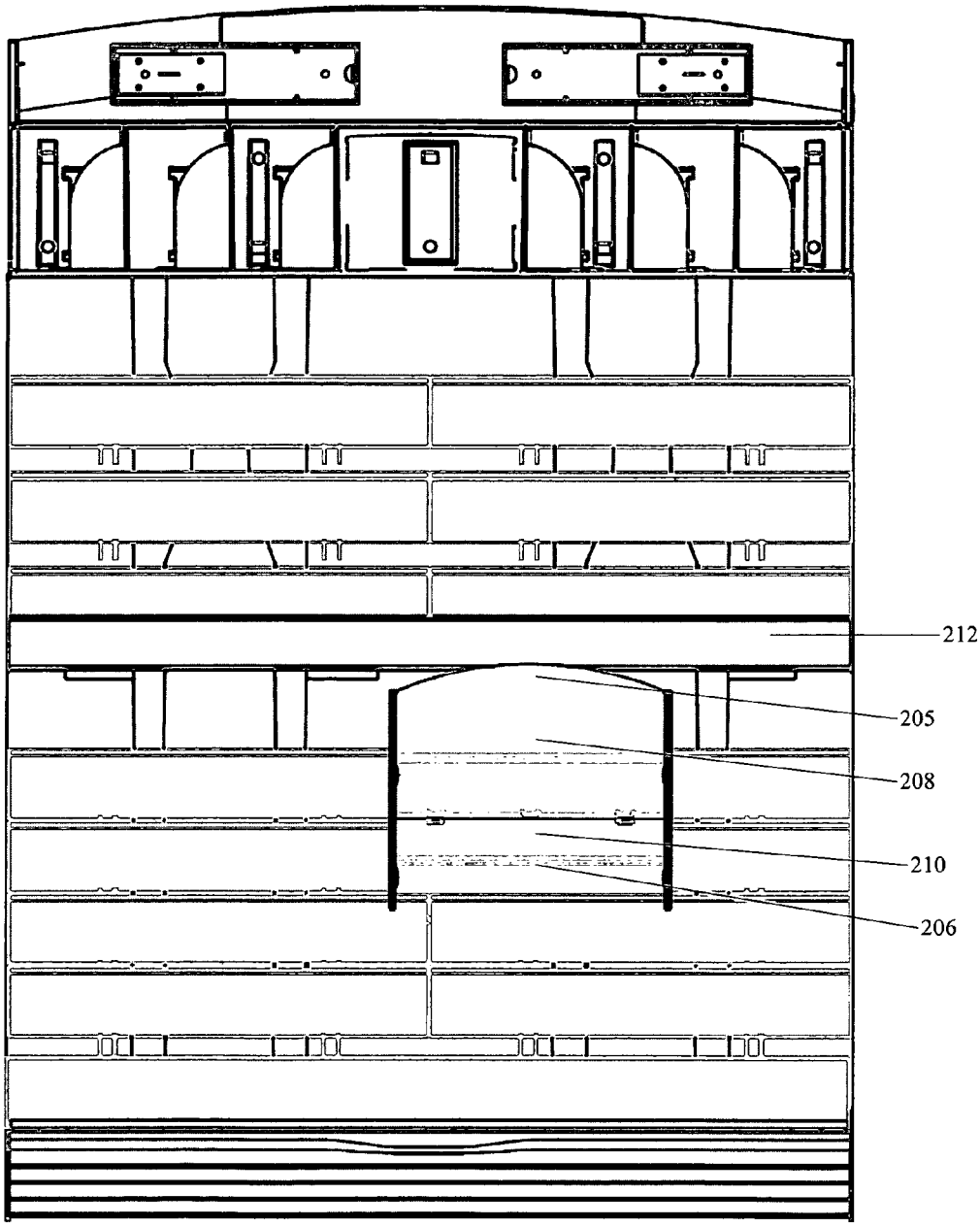
FIG. 2 illustrates a card display rack according to another exemplary embodiment of the present invention.

The card display rack 104 may also comprise a flat-facing A-SKU card highlighter holder 186. In one exemplary embodiment, the flat facing A-SKU holder 186 has a width of 28.949 inches. The flat-facing holder 186 is typically positioned on the row of pockets 166 immediately above the caption strip 174 in order to have the best opportunity to attract the consumer's attention. The flat-facing holder 186 typically includes card dividers 188, 190 on each opposing end, extending in the vertical direction. The flat-facing holder 186 can also include a back member 192 that is generally taller than the back members 160 for the pockets 166 in the card display rack 104. The back member 192 for the flat-facing A-SKU card highlighter holder 186 is substantially dome-shaped. The back member is typically positioned even with the back member 160 at each opposing end of the flat-facing holder 186 and extends in the upward direction towards the middle of the holder, as shown in FIGS. 1 and 2.

The flat-facing holder 186 also includes a bottom member 193 (not shown) that is substantially similar to the bottom member 162 for the pockets 166. The flat-facing holder 186 further includes a front member 194 that is substantially similar to the front member 164 of the pockets for the first row above the caption strip 174. The flat-facing A-SKU card highlighter holder 186 may also include an opaque graphic 196 that extends from one end of the front member 194 to the other end of the front member 194 in substantially the shape of a "U" or inverted dome. The flat-facing holder 186 may be slidably inserted into the sham of multiple pockets 166. Just as in the curved A-SKU holder 178, the holder 186 highlights A-SKU level cards. In one exemplary embodiment, the flat-facing holder 186 has the capability of holding five cards.

Figure 9:
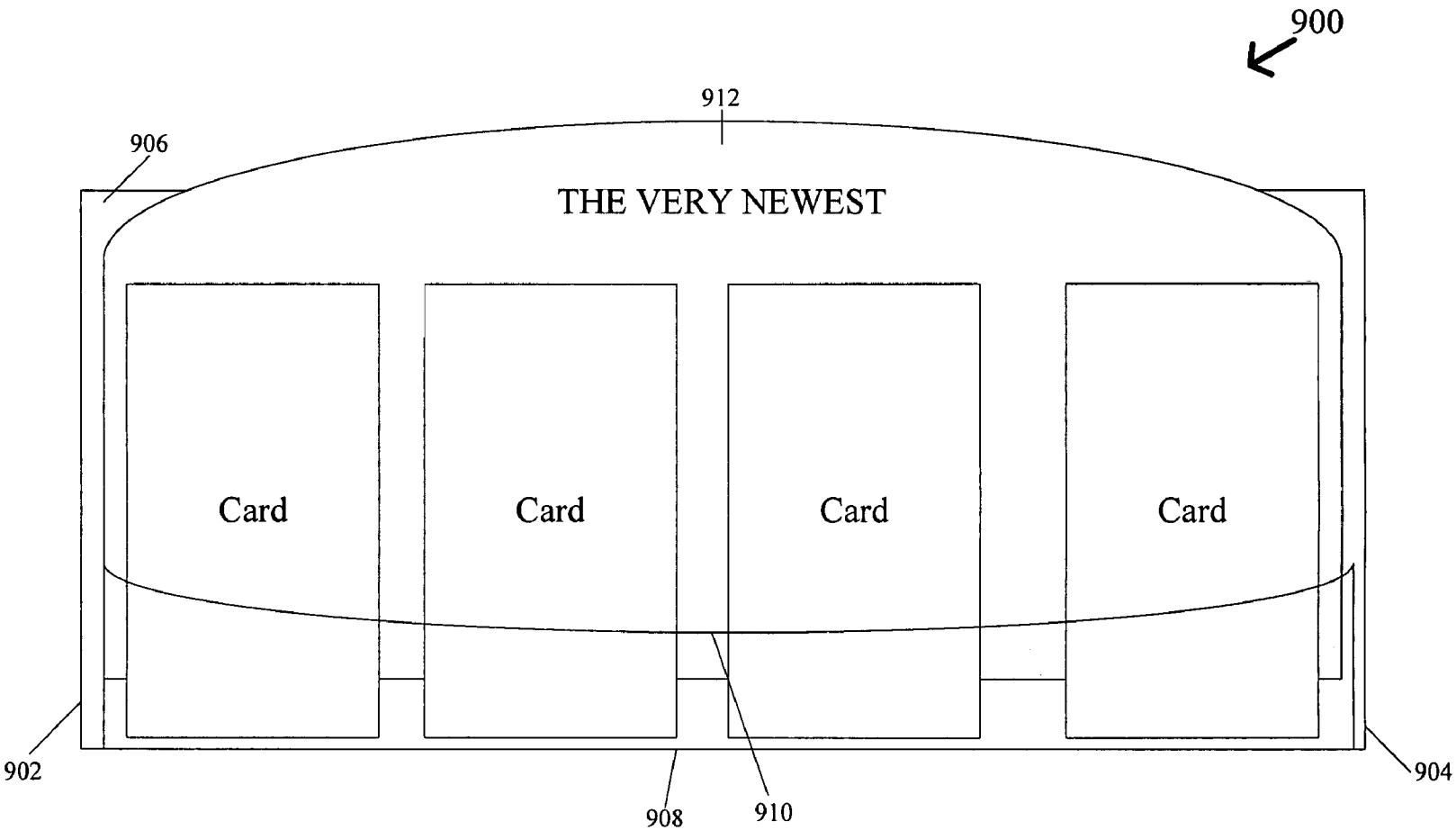
FIG. 9 illustrates the A-SKU highlighter for the exemplary card display rack of FIG. 1.

FIG. 9 provides a detailed drawing of an alternative embodiment of the flat-facing A-SKU highlighter holder. Now referring to FIG. 9, the alternative flat-facing A-SKU highlighter holder 900 includes card dividers 902, 904 on each opposing end, extending in the vertical direction. The flat-facing holder 900 can also include a substantially rectangular back member 906 orthogonally attached at each end to the card dividers 902, 904. The back member 906 is typically positioned even with the back member 160.

The flat-facing holder 900 also includes a bottom member 908 orthogonally attached to the card dividers 902, 904, and the back member 906 along the bottom sides of each. The bottom member 908 is substantially similar to the bottom member 162 for the pockets 166 of FIG. 1. The flat-facing holder 900 further includes a front member 910 that is substantially similar to the front member 164 of the pockets 166 for the first row above the caption strip 174.

The holder 900 also includes a dome-shaped graphic card 912. The graphic card is slidably inserted into the holder 900 in front of the back member 906 and between the dividers 902, 904. The graphic card 912 is typically positioned behind the cards in the A-SKU holder 900. The graphic card 912 has a height greater than the back member 906 at its upper-most point. The graphic card 912 typically includes pictures, color, graphics, and/or text intended to draw the consumers attention to the holder 900. As described in FIG. 9, the use of the legend "the very newest" on the graphic card 912 is meant to highlight or emphasize to the consumer that new cards are available in the highlighter 900. The holder 900 may also include an opaque graphic 914 that extends from one end of the front member 910 to the other in a substantially "U" shape or inverted dome. The flat-facing holder 900 may be slidably inserted into the sham of multiple pockets 166. Just as in the curved A-SKU holder 178, the holder 900 highlights A-SKU level cards. In one exemplary embodiment, the flat-facing holder 900 has the capability of holding five cards.

4. B-SKU Highlighters

Returning to FIG. 1, the card display rack 104 may also include a multi-tiered flat-facing B-SKU card display holder 198. B-SKU highlighters are generally used to highlight B-SKU cards. The B-SKU card display holder 198 is typically positioned below the caption strip 174. The holder 198 is intended to attract the attention of the consumer searching for cards below the caption strip by providing full-faced cards in a manner that is different that the display of the rest of the cards below the caption strip 174. In one exemplary embodiment, each of the cards in the B-SKU highlighter 198 are related to the same particular theme or subcategory within a card occasion. The exemplary highlighter 198 has a width of 15.963 inches. In one exemplary embodiment, the multi-tiered holder 198 has the ability to hold six full-faced cards consisting of two rows of three cards in the horizontal direction. The two rows created by the multi-tiered holder 198 typically occupy the same or similar space as three rows of the pockets 166 in order to present the cards in a full-facing manner.

The multi-tiered holder 198 includes dividers 200, 202 extending in the vertical direction on each of the opposing ends of the display holder 198. Each divider 200, 202 typically extends outward from the card display rack 104 at the bottom member 204 (not shown) for the bottom row of cardholders. The divider 200, 202 extends in the vertical direction to or substantially to the point of the bottom member of the upper row of the display holder 198. At that point, the dividers 200, 202 in a gently sloping manner, converge to a point at the back member 205 of the top row of the multi-tiered holder 198, as shown in FIGS. 1 and 2.

The multi-tiered holder 198 further includes front members 206, each typically made of a clear material, such as plastic, so that the entire front of the card may be viewed by a consumer without having to remove the card from the pocket 166. The multi-tiered holder 198 also includes a top row 208 and a bottom row 210, each having a back member 160 and bottom member 162. The multi-tiered holder 198 may be slidably inserted into the shams for the pockets 166, so that the holder 198 may be used in place of one or more pockets 166.

The back member 205 for the top row of the multi-tiered display holder 198 includes a portion of the back member 205 that rises in a vertical direction above and to a point higher than the back members of the pockets 166 in the same row as the top row 208 of the holder 198. The back member 205 is typically dome-shaped. Each opposing end of the back member 205 is equal with the back members 160 of the pockets 166 and abuts against and rises at the center point of the back member 205 to a point higher than the back members 160 of the pockets 166 in the row. In one exemplary embodiment, the multi-tiered holder 198 replaces a section of rows below the caption strip 174. The dividers 200, 202 and back member 205 of the multi-tiered display holder 198 are typically opaque and, in one exemplary embodiment, have the same color as one another.

Figure 10:
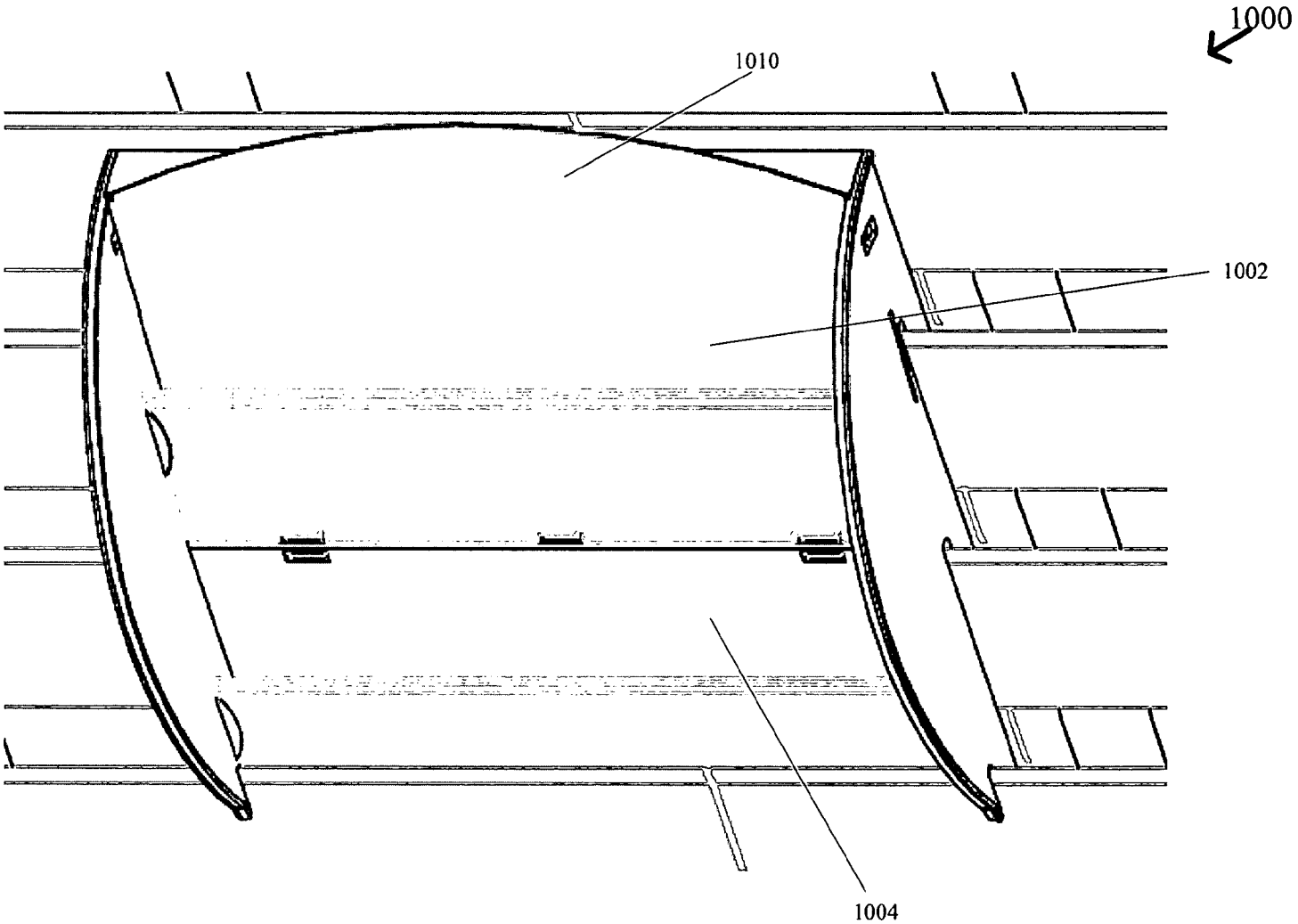
FIG. 10 illustrates the B-SKU highlighter for the exemplary card display rack of FIG. 1.

FIG. 10 provides a detailed drawing of an alternative embodiment of the multi-tiered B-SKU holder. Referring to FIG. 10, the alternative multi-tiered holder 1000 is substantially similar to the holder 198 of FIG. 1, the differences being described below. The B-SKU holder 1000 is generally presents cards in a full-facing or nearly full-facing manner and is positioned below the caption strip 174 to attract the attention of consumers looking for cards in that area by displaying cards differently from the other cards displayed below the caption strip and providing eye-catching graphics. The cards presented in the holder 1000 typically include B-SKU level cards. As provided in FIG. 10, all of the cards in the holder 1000 can be organized under the same category, "wedding." The B-SKU level wedding cards in the holder are highlighted to attract attention from the C-SKU level cards that make up the remainder of the cards presented in the display rack below the caption strip 174. The multi-tiered holder 1000 includes a top row 1002 and a bottom row 1004, each having a back member 1006 (not shown) and bottom member 1008 (not shown). The back member 1006 for the top row 1002 has a substantially rectangular shape. The multi-tiered holder 1000 further includes a graphic card 1010 having a substantially domed-shape. The graphic card 1010 rises in a vertical direction above and to a point higher than the back member 1006 of the pockets 1014. Each opposing end of the graphic card 1010 is substantially equal with the back member 1006 and rises at the center point to a position higher than the back member 1006. In one exemplary embodiment, the graphic card 1010 includes pictures, color, graphics, and/or text designed to attract the attention of the consumer to the multi-tiered holder 1000. In one exemplary embodiment, the graphic card 1010 has an opaque background with the phrase "see what's new" printed on the card 1010. The use of a legend like "the very newest," on the graphics card 1010 is meant to highlight or emphasize to the consumer that the cards presented in that highlighter 1000 are the newest style of cards available in the display rack 104.

5. Caption Strip

Returning to FIG. 1, the card display rack 104 also includes a caption strip 174. The caption strip 174 provides visual relief from a sea of cards. The caption strip 174 also assists the consumer in determining the occasion for the cards. The graphic in the caption strip 174 has a different color based on each card occasion. Thus, the consumer is able to know by the color of the graphic in the strip 174 what occasion of cards are above and below the caption strip 174. The caption strip 174 typically extends from the first angled member 128 to the second angled member 130 in a horizontal manner. For example, the caption strip 174 typically runs between a second group of rows 158 that are above the caption strip 174 and a first group of rows 156 that are below the caption strip 174. The caption strip 174 includes a graphics holder (not shown) having receptacles (not shown) at the top and bottom of the caption strip 174 so that a graphic can be slidably inserted into the caption strip 174 or snapped into the strip 174 from the front.

6. Header Graphics

Figure 3:
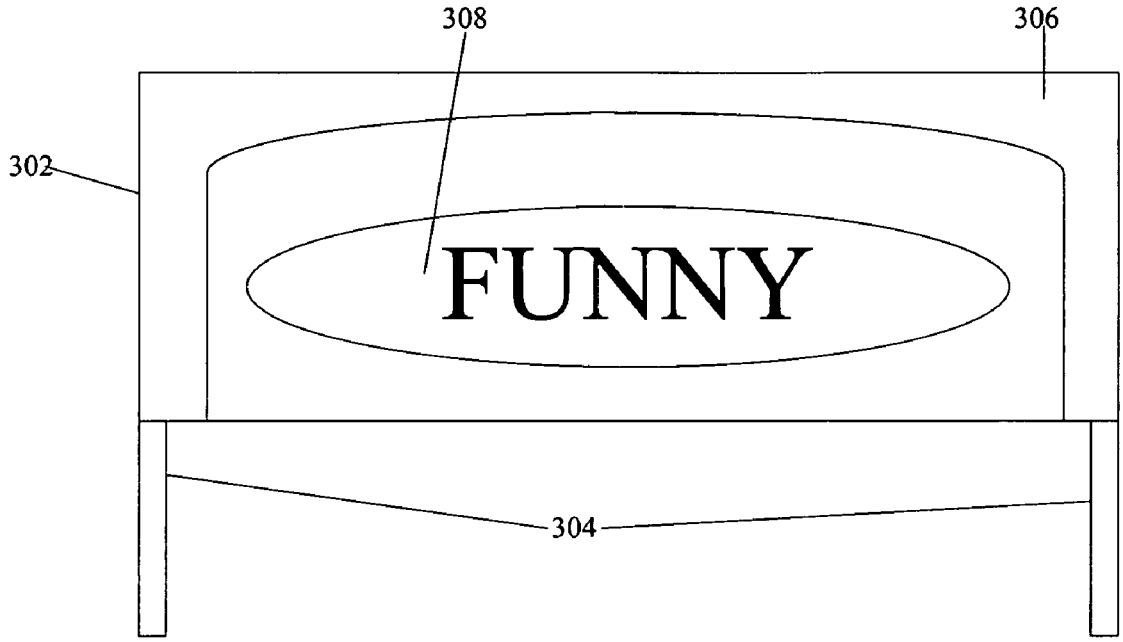
FIG. 3 illustrates the header display for a card display rack according to an exemplary embodiment of the present invention.

As shown in FIG. 3, the card display rack 104 may also include a marquee display panel 302 positioned above and attached to the fifth 138 and sixth 140 vertical members. In an alternative embodiment, the marquee display panel is attached to the top of the shadowbox display 142, 144. The marquee display panel 302 provides visual cues to a consumer about the occasion associated with cards located in the display 100 and below the panel 302. The marquee display panel 302 is typically attached to the fifth 138 and sixth 140 vertical members using L-shaped brackets 304 or other methods known to those of ordinary skill in the art. The marquee display panel 302 includes a flat panel 306 having a width in the horizontal direction that is substantially greater than its height. The flat panel 306 comprises receptacles (not shown) positioned at the top and bottom and within the front of the flat panel 306, facing outward from the card display rack 104. The receptacles can accept a graphic 308 inserted or snapped into the front of the flat panel 306. The graphics card 308 for the marquee display panel 302 is typically dome-shaped, having a height at its center that is greater than the height on each opposing end of the graphics card 308. The graphics card 308 provides information to the consumer about the type of card that may be found directly beneath the dome-shaped graphics card 308 and within the display rack 104. The flat panel 306 of the marquee display panel 302 may be made of a variety of materials, such as wood, metal, or hard plastic.

FIG. 8 provides an alternative embodiment of the marquee display panel. Now referring to FIG. 8, the alternative marquee display panel 830 includes a left member 832 attached to the sixth member 140 (not shown) and extending in the vertical direction upward therefrom. The panel further includes a right member 834 attached to the fifth member 138 (not shown) and extending in the vertical direction upward therefrom. The right member 834 and left member 832 are substantially parallel to each other. The marquee 830 further includes a domed-shaped graphics card 836, having a height at its center that is greater than the height on each opposing end of the graphics card 836. The graphics card 836 is capable of being slidably inserted, or snapped, into the left 832 and right 834 members. The graphics card may include pictures, text, color, or graphics to describe the category of cards located below the graphics card 836 in the display rack 104. In one exemplary embodiment, the cards are organized by category in a vertical manner. A category is typically provided at or near the top of the display rack with all or substantially all of the cards presented below that category being generally described as belonging to that category.

The graphics card 836 may further include one or more category graphic holders 838. Each category graphic holder 838 typically includes a top 840 and bottom 842 horizontal member positioned substantially parallel to one another. The holder 838 further includes a vertical member 844 orthogonally attached to an end of each of the top 840 and bottom 842 members. The graphics card 836 may further include a category graphic 846 having a substantially rectangular shape. The category graphic 846 is capable of being slidably inserted, or snapped, into or between the top 840, bottom 842, and vertical 844 members. The category graphic 846 may be made of card plastic, or metallic stock and typically includes the name of one or more card categories (i.e. Birthday, Anniversary, Wedding, etc.). As shown in FIG. 8, the category "Baby" is presented. The category graphic 846 provides a description of the category of cards located below the graphics card 836.

Each shadowbox 802 further includes a graphic card 848. The graphic card 848 provides the name of a subcategory for the card provided in the shadowbox 802. The subcategory provides a more detailed description of the person to whom the card is intended for a particular category. Subcategories may include familial designations, such as brother, sister, etc., or attitudinal designations, such as funny, caring, etc. Each shadowbox 802 may include cards with the same or different categories. In one exemplary embodiment, the cards in the shadowboxes 802 on each side of the graphic 826 are matched, such that, for example, the subcategories on each side of the graphic 826 are the same except that one sex is represented on one side of the graphic 826 and the other sex is represented on the other side of the graphic 826. In one exemplary embodiment cards in the shadowboxes 802 on one side of the graphic 826 are for a baby girl and cards in the shadowboxes 802 on the other side of the graphic 826 are for baby boys.

Figure 1A:
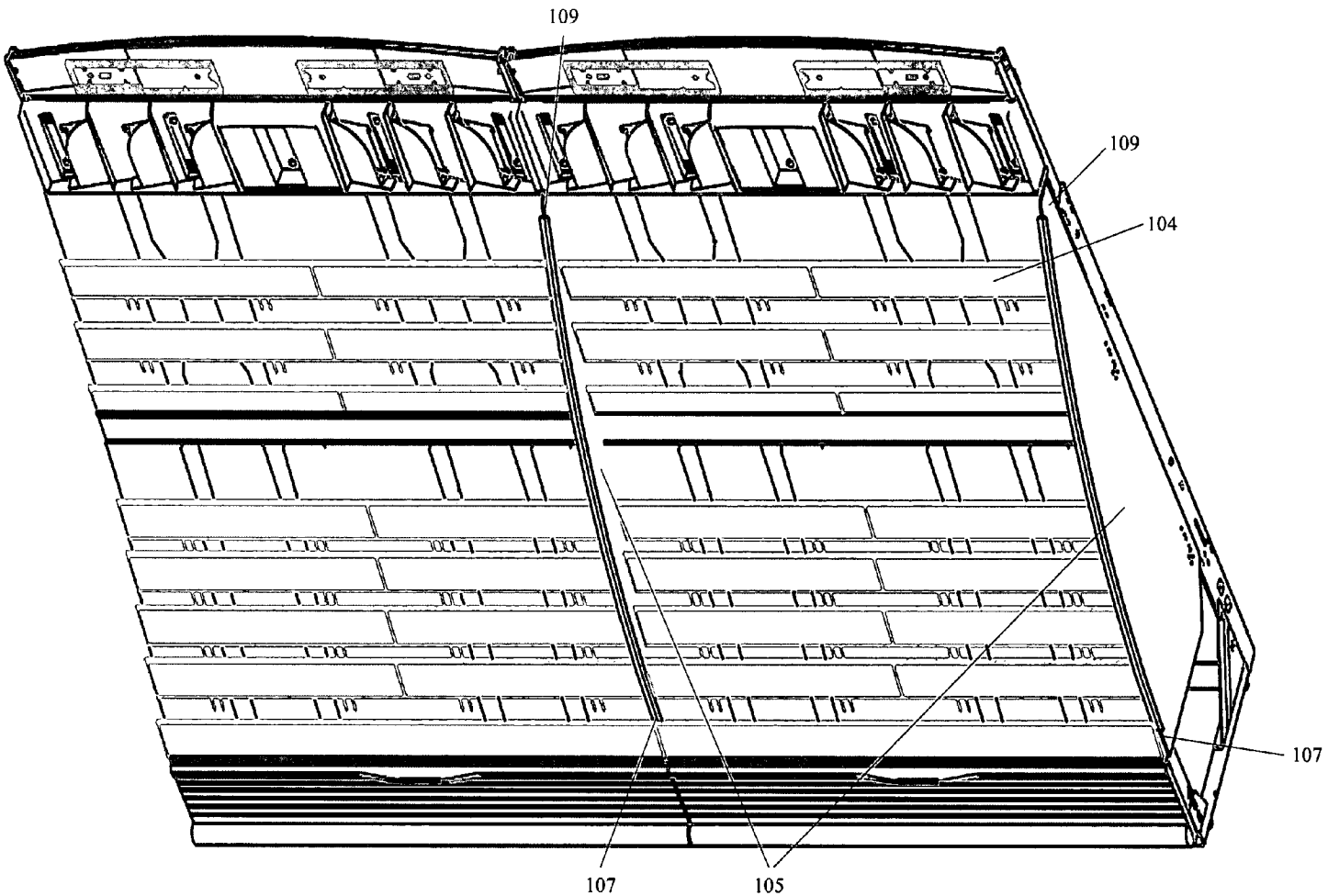
FIG. 1A illustrates another view of the card display rack according to the exemplary embodiment of FIG. 1.
Figure 1B:
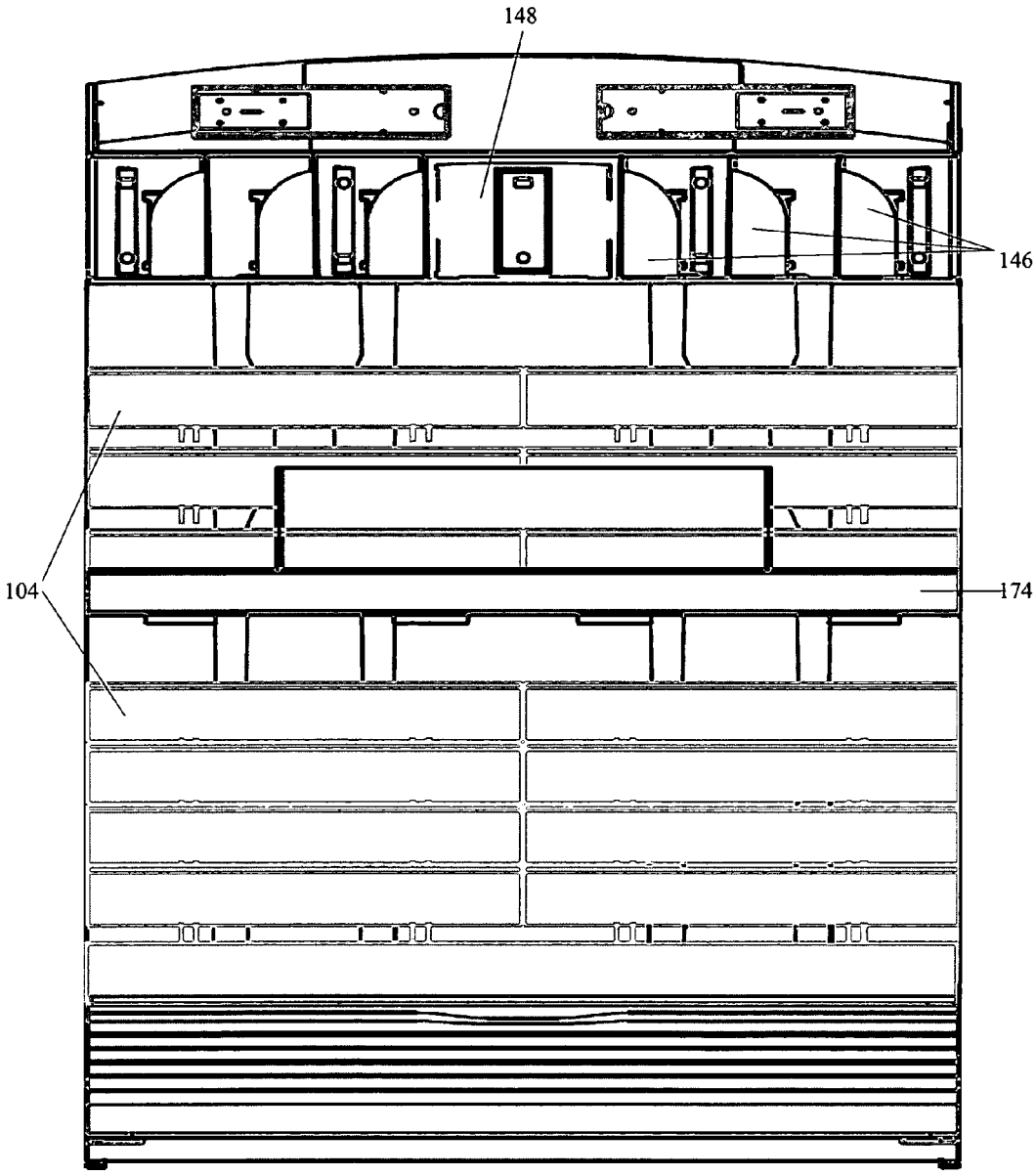
FIG. 1B illustrates another view of the card display rack according to the exemplary embodiment of FIG. 1.

FIG. 1A provides another detailed drawing of the exemplary display rack 104. Now referring to FIG. 1A, the display rack further includes a category separator 105. The category separator 105 is typically positioned along the edge of the display rack 104. The category separator 105 presents a visual cue to the consumer that each side of the category separator 105 displays cards for a different category (i.e. Wedding, Birthday, Anniversary, etc.). The category separator 105 has a substantially convex shape extending out and away from the front of the displayed cards. The category separator 105 is typically attached at its bottom end 107 to a first 116 or second 118 vertical member. A top end 109 of the category separator 105 is attached at or substantially near the top of the third 120 or fourth 122 vertical members. Each category separator 105 can be made of clear or semi-clear plastic materials. In one exemplary embodiment, the category separator 105 is made of a partially translucent acrylic. FIG. 1B provides another view of the exemplary display rack 104. As shown in FIG. 1B, the exemplary rack 104 has a width of 48.084 inches and a height of 69.419 inches. The top of the exemplary rack 104 includes three shadowboxes 146 on each side of a display panel 148.

C. Alternate Display Rack

1. SKU Highlighters

Figure 4:
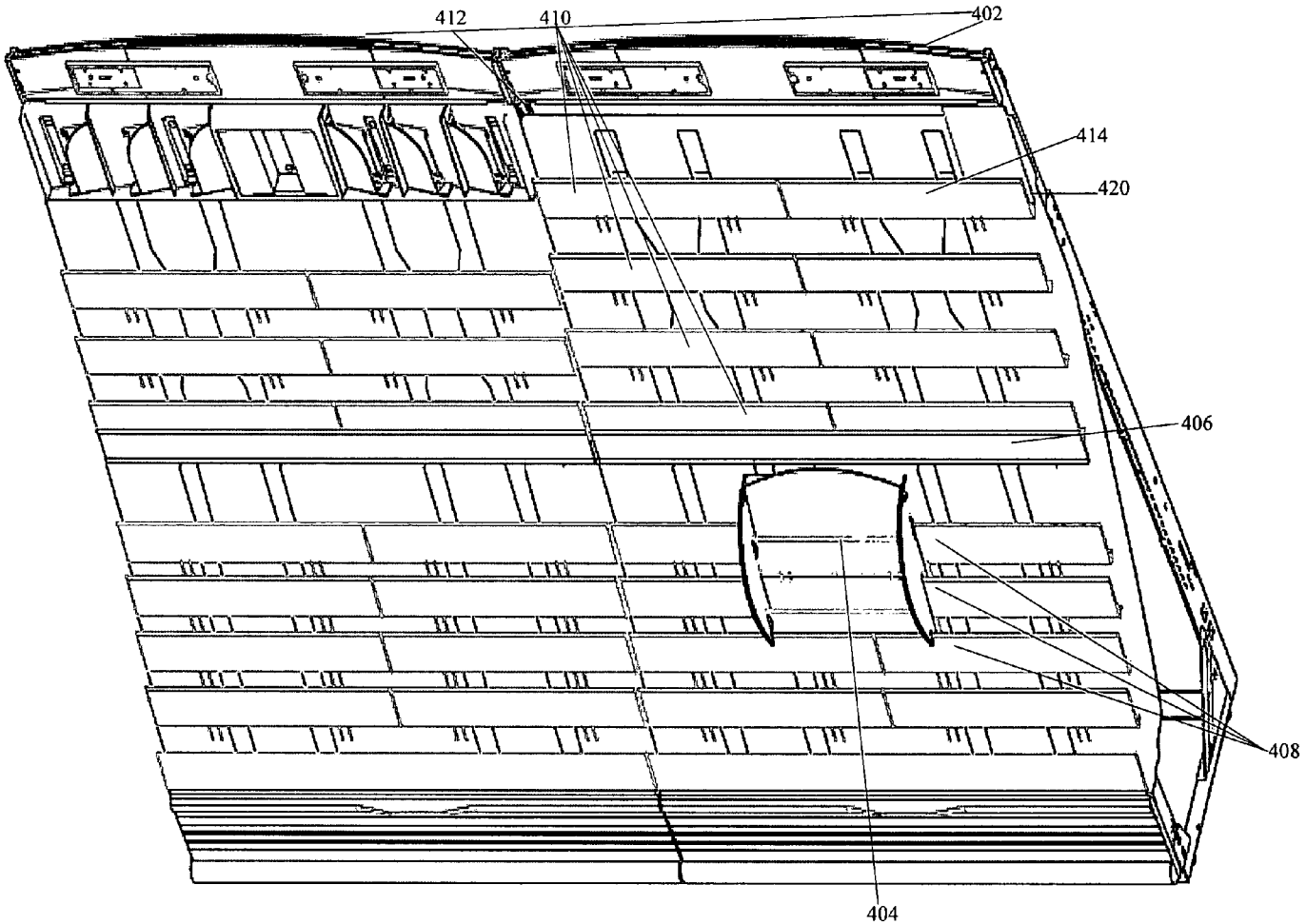
FIG. 4 illustrates a second card display rack according to a further exemplary embodiment of the present invention.

FIG. 4 provides a detailed drawing of a second exemplary embodiment of the card display rack 402. The rack 402, as shown, includes three separate four foot sections of rack 402 placed substantially close to one another. The differences between the embodiments of FIGS. 1, 2, and 3 and the embodiment of FIG. 4 will be described herein. The card display racks 402 may include a curved multi-tiered B-SKU card display holder 404 ("curved multi-tiered holder") (not shown) that is typically positioned below the caption strip 406, as shown in FIG. 4. The curved multi-tiered holder 404 includes back members (not shown), bottom members (not shown), and front members (not shown) for multiple rows of cards, each in a convex manner. The opposing ends for back, bottom, and front members are substantially in-line and parallel with the pockets in the card display rack 402. The midpoint of each row of the curved multi-tiered holder 404 extends outward from the card display rack 402, thereby creating a three-dimensional effect that attracts the attention of a consumer.

The front member 407 (not shown) of the bottom row of the curved multi-tiered holder 404 is made of a clear material, such as plastic. This allows a consumer to view the full face of a card displayed without a requirement for the consumer to remove the card from the holder 404. The holder 404 is typically attached as a single apparatus to the rack 402 along the rows 408. The curved multi-tiered holder 404 typically presents B-SKU level cards to a consumer. B-SKU level cards visually signal a newness across a breadth of occasions and consumer lifestyles. B-SKU level cards are not quite as trendy and daring as A-SKU level cards but they do illustrate emerging trends related to one or more occasions. In one exemplary embodiment, shams for five rows of standard pockets 166 are removed and replaced with the curved multi-tiered holder 404.

2. Full-Faced Cards

As shown in FIG. 4, rows 410 of full-faced cards are positioned above the caption strip 406 and on one side of and abutting the shadowbox display 142. Displaying cards in a full-faced manner promotes the "art of the card" and provides the consumer with the ability to review the cards at a quicker rate without a need to view less interesting cards presented by the display rack 402. The top row of the full-faced cards is attached to the fifth vertical member 138 and the seventh vertical member 412 (not shown). The top row of the full-faced cards 414 includes a substantially vertical back member 416 (not shown), a gently sloping (or horizontal) bottom member 418 (not shown), and a substantially vertical (or steeply sloping) front member 420. The back 416, bottom 418, and front 420 members can be manufactured from a variety of conventional materials, including wood, metal, and plastic. The front member 420 is generally made of a clear material, such as plastic. Each descending row, positioned below the top row 414 and adjacent to the shadowbox display 142, comprises back, bottom, and front members that are similar to corresponding members for the top row. These members are attached on one end to the first angled member 128 and attached on the opposing end to the pockets 166 displayed below the shadowbox display 142. In one exemplary embodiment, four full-faced rows of cards are displayed above the caption strip 406 and adjacent to the shadowbox display 142. In the exemplary display 402, the vertical distance from the bottom row of cards to the top of the top row 414 is 60.681 inches.

Figure 4A:
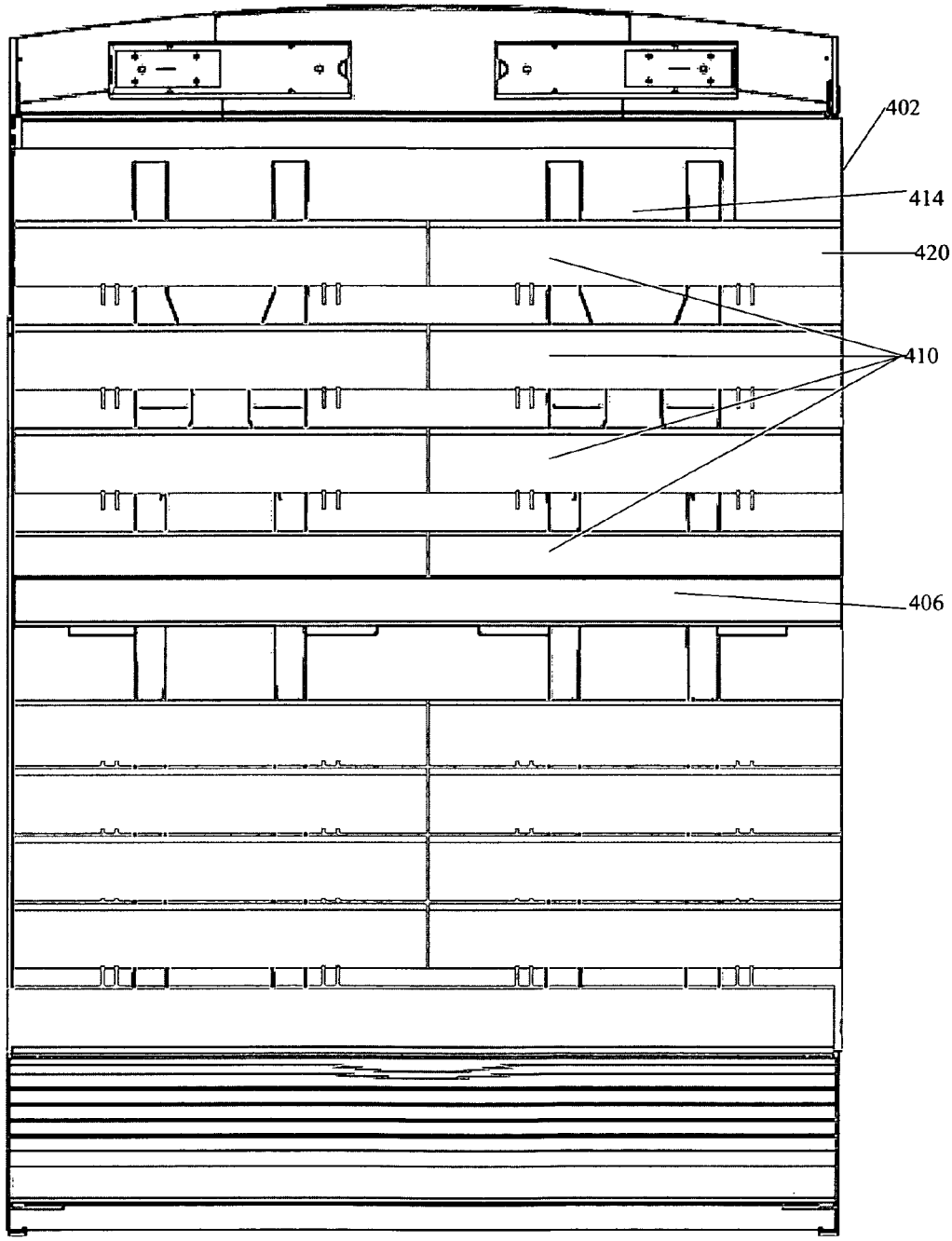
FIG. 4A illustrates another view of the second card display rack according to the exemplary embodiment of FIG. 4.

FIG. 4A provides another detailed drawing of the exemplary display rack 402. As shown in FIG. 4A, the exemplary rack 402 has a width of 48.084 inches and a height of 71.457 inches. The display area above the caption strip 406 includes four rows of full facing cards; nine total rows of cards are displayed on the display rack 402. Each row typically contains eight cards.

Figure 4B:
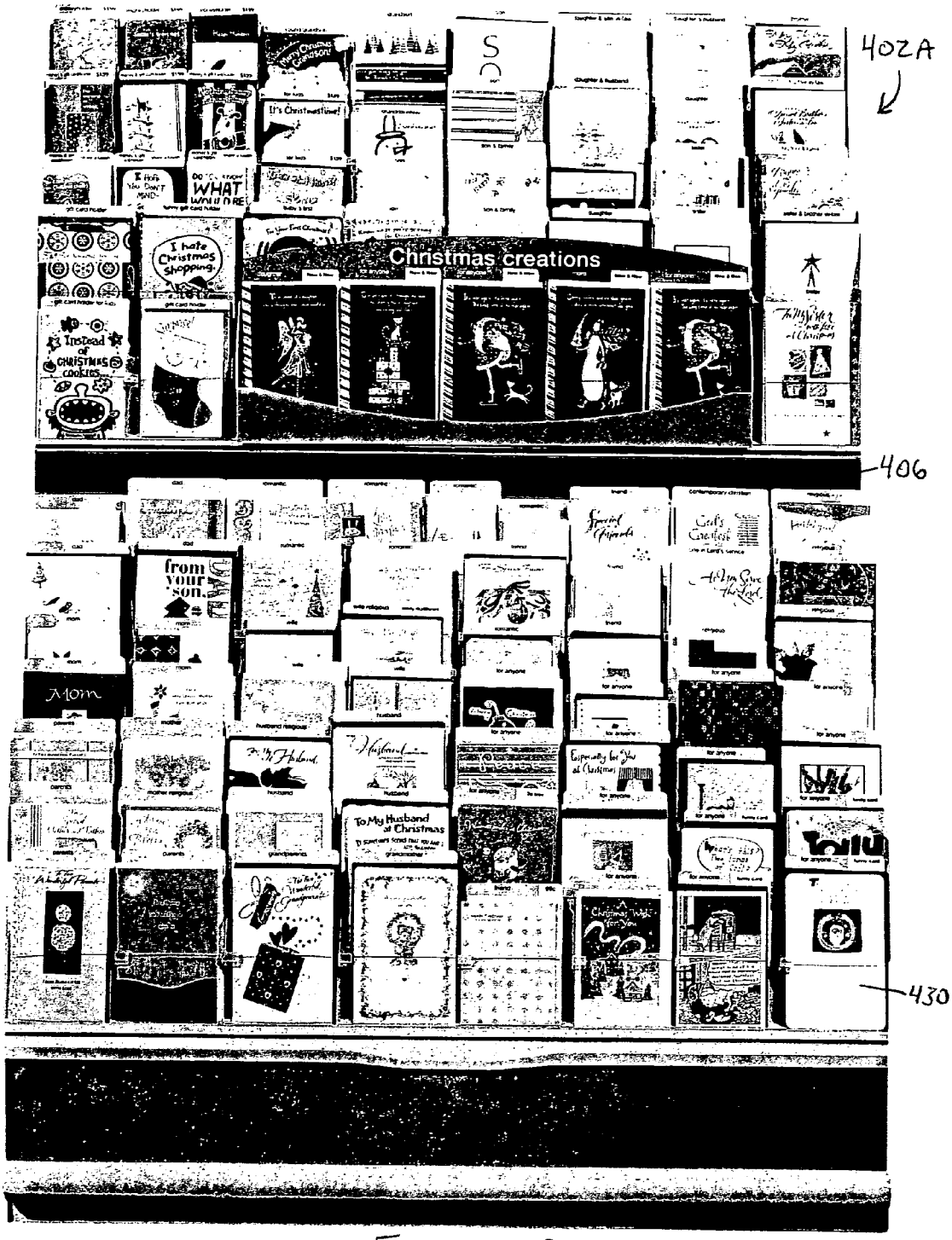
FIG. 4B illustrates another display layout for the exemplary card display rack of FIG. 4.

FIG. 4B provides a detailed drawing of an alternative embodiment of the display rack 402. Referring to FIG. 4B, the alternative display rack 402A differs from the rack 402 of FIG. 4 in that the alternative rack 402A includes twelve rows of cards in the same vertical distance as the nine rows of FIG. 4. The alternative rack 402A only presents two full facing rows of cards, the first row immediately above the caption strip 406 and the second as the bottom row 430. In one exemplary embodiment, the alternative rack 402A is typically used for displaying seasonal cards. Seasonal cards are typically associated with a particular holiday or time of the year (i.e. Christmas, Thanksgiving, Halloween, etc.) and displayed for a short period of time.

D. Window Box End Cap

Figure 5:
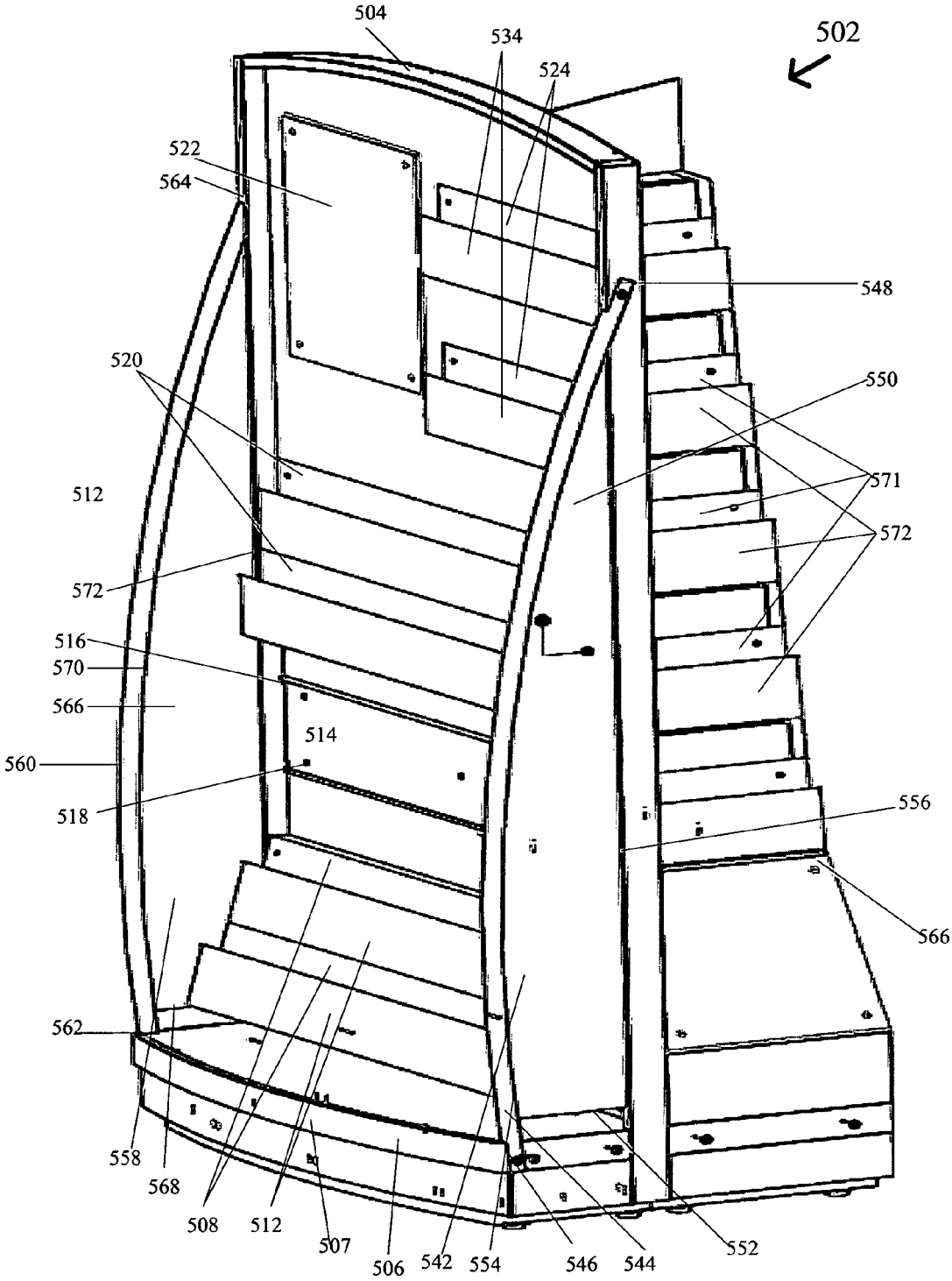
FIG. 5 illustrates a perspective view of a window-box end cap according to one exemplary embodiment of the present invention.

The adjustable display assembly 100 may also include an end cap 502 orthogonally attached or placed adjacent to one end of the card display rack 104. One exemplary embodiment of the end cap concept is shown in FIG. 5. The window box end cap 502 provides the consumer with a view, as if through a store window, into the retail card area. Cards and graphics are placed on the end cap 502 to provide the consumer with an initial impression of the content of the retail card area. The exemplary end cap 502 of FIG. 5 includes a dome-shaped panel 504 having a height of seventy-two inches. In an alternative embodiment of the end cap 502, the dome-shaped panel 504 has a height of sixty-seven inches. The width of the exemplary end cap 502 is substantially equal to the width of two frames for the display rack 104 place back-to-back against one another, or approximately thirty-six inches wide. The exemplary end cap 502 can further include a kick-plate 506, having a substantially rectangular shape, positioned at or near the bottom of the end cap 502. The exemplary kick-plate 506 is positioned at the base of the end cap 502 and rises approximately six inches vertically therefrom. The kick-plate also extends outward orthogonally form the panel 504 approximately six inches. The front side 507 of the kick-plate 506 has a substantially convex shape. The horizontal width of the kick-plate graphic 506 typically extends along the width of the exemplary end cap 502.

The exemplary end cap 502 may also include rows of pockets 508 positioned above the kick-plate 506. A first group of rows of pockets 508 typically includes a vertical back member 510 (not shown), a gently sloping (or horizontal) bottom member 511 (not shown) orthogonal to the plane of the exemplary end cap and a substantially vertical (or steeply angled) front member 512. The pockets 508, which typically comprise wood, metal, or plastic materials, may be attached by conventional attachment means, welding or molded from a single piece of plastic. Each exemplary pocket 508 is capable of presenting cards in a full-facing manner. When a card is presented in a full-facing manner, all or substantially all of the front of the greeting card may be viewed without having to remove the card from the pocket 508. By displaying cards in a full-facing manner, it highlights the artistic beauty of the cards. In one exemplary embodiment, two rows of pockets are positioned above the kick-plate 506.

The exemplary end cap 502 also includes a horizontal graphic 514 positioned above the first group of rows of pockets 508. The horizontal graphic 514 has a substantially rectangular shape and may be attached to the end cap 502 by being slidably inserted into and/or behind a plastic sheath (not shown) attached to the end cap 502. In another exemplary embodiment, the graphic 514 may be attached to the end cap 502 at the top and bottom corners 516, 518 of the horizontal graphic 514 by using known attachment methods. The end cap 502 also includes a second group of rows of pockets 520 positioned above the horizontal graphic 514 and substantially in-line with the first group of rows of pockets 508. Similar to the first group of rows of pockets 508, the second group of rows of pockets 520 includes a vertical back member 510 (not shown), a gently sloping (or horizontal) bottom member 511 (not shown) orthogonal to the plane of the exemplary end cap 502 and a substantially vertical (or steeply angled) front member 512. Each exemplary pocket 520 is capable of presenting several cards in a full-facing manner. In one exemplary embodiment, the second group of pockets 520 includes two rows of pockets capable of holding up to six cards on each row.

The end cap 502 also includes a window box graphic 522 positioned above the second group of pockets 520. The window box graphic 522 has a substantially rectangular shape with its longest side extending in the vertical direction. The window box graphic 522 typically includes a picture or graphic on card or plastic stock that is capable of being attached to the end cap 502. The picture or graphic can be attached to the end cap 502 by being slidably inserted into and/or behind a plastic sheath (not shown) attached to the end cap 502. In another exemplary embodiment, the graphic 522 may be attached to the end cap 502 by the use of known attachment methods or slidably inserted into a receptacle (not shown) attached to the end cap 502.

The end cap 502 also includes a third group of full-facing card rows 524 positioned on one side of, and adjacent to, the window box graphic 522, above the second group of pockets 520. Each row of full-facing pockets 524 typically includes a substantially vertical (or steeply sloping) front member 534. The pockets 524 also include a gently sloping (or horizontal) bottom member 536 (not shown) extending orthogonally from the end cap 502 and attached to the bottom portion of the front member 534. The cardholders 524 further include a left-side member 538 (not shown) orthogonally attached on one end to the left side of the front member 534 and the left side of the bottom member 536 and orthogonally attached on the other end to the end cap 502. The pockets 524 further include a right-side member 540 (not shown) orthogonally attached on one end to the front member 534 and the bottom member 536 and orthogonally attached on the other end to the end cap 502. In one exemplary embodiment, the front 534, bottom 536, right-side 540, and left-side 538 members of the full-facing pockets 524 are made of a clear material, such as plastic. As shown in the exemplary embodiment of FIG. 5, two rows of full-facing pockets 524 can be positioned to the right side of the window box graphic 522

The exemplary end cap 502 further includes a right-side screen 542 and a left-side screen 558. The right-side screen 542 is substantially positioned on the right edge of the kick-plate 506 and the panel 504. The left-side screen 558 is substantially positioned on the left edge of the kick-plate 506 and the panel 504. The right-side screen 542 includes a first vertical member 544 extending upward from and orthogonally attached to the right, front corner 546 of the kick-plate 506. The first vertical member 544 has a substantially convex shape and has its other end attached to the right side 548 of the panel 504 at a height approximately eight inches below the top of the panel 504. The right-side screen 542 further includes a translucent panel 550 having a bottom edge 552 approximately six inches above the kick-plate 506, its front edge 554 orthogonally attached to the first vertical member 544, and its back edge 556 orthogonally attached to the right side 548 of the panel 504.

The left-side screen 558 includes a second vertical member 560 extending upward from and orthogonally attached to the left, front corner 562 of the kick-plate 506. The second vertical member 560 has a substantially convex shape and has its other end attached to the left side 564 of the panel 504 at a height approximately eight inches below the top of the panel 504. The left-side screen 558 further includes a translucent panel 566 having a bottom edge 568 approximately six inches above the kick-plate 506, its front edge 570 orthogonally attached to the second vertical member 560, and its back edge 572 orthogonally attached to the left side 564 of the panel 504.

The exemplary end cap 502 further includes a second panel 566 and a third panel 568 (not shown). The second panel 566 is orthogonally attached to the back side of the panel 504 and extends from the top of the panel 504, at substantially its mid point, to the right side of the panel 548 at a position approximately six inches above the height of the kick-plate 506. The third panel 568 is orthogonally attached to the back side of the panel 504 and extends from the top of the panel 504, at substantially its mid point, to the left side of the panel 564 at a position approximately six inches above the height of the kick-plate 506. Both the second 566 and third 568 panels further include multiple full-faced pockets 570. Each full-facing pocket 570 typically includes a substantially vertical (or steeply sloping) front member 572. The pockets 570 also include a gently sloping (or horizontal) bottom member 574 (not shown) extending orthogonally from the second 566 or third 568 panel and attached to the bottom portion of the front member 572. The pocket 570 further includes a left-side member 576 (not shown) orthogonally attached on one end to the left side of the front member 572 and the left side of the bottom member 574 and orthogonally attached on the other end to the second 566 or third 568 panel. The pocket 570 further includes a right-side member 578 (not shown) orthogonally attached on one end to the front member 572 and the bottom member 574 and orthogonally attached on the other end to the second 566 or third 568 panel. In one exemplary embodiment, the front 572, bottom 574, right-side 578, and left-side 576 members are made of a clear material, such as plastic. The second 566 and third 568 panels are typically attached to the panel 504 using well-known attachment methods.

E. Second Exemplary End Cap Design

Figure 6:
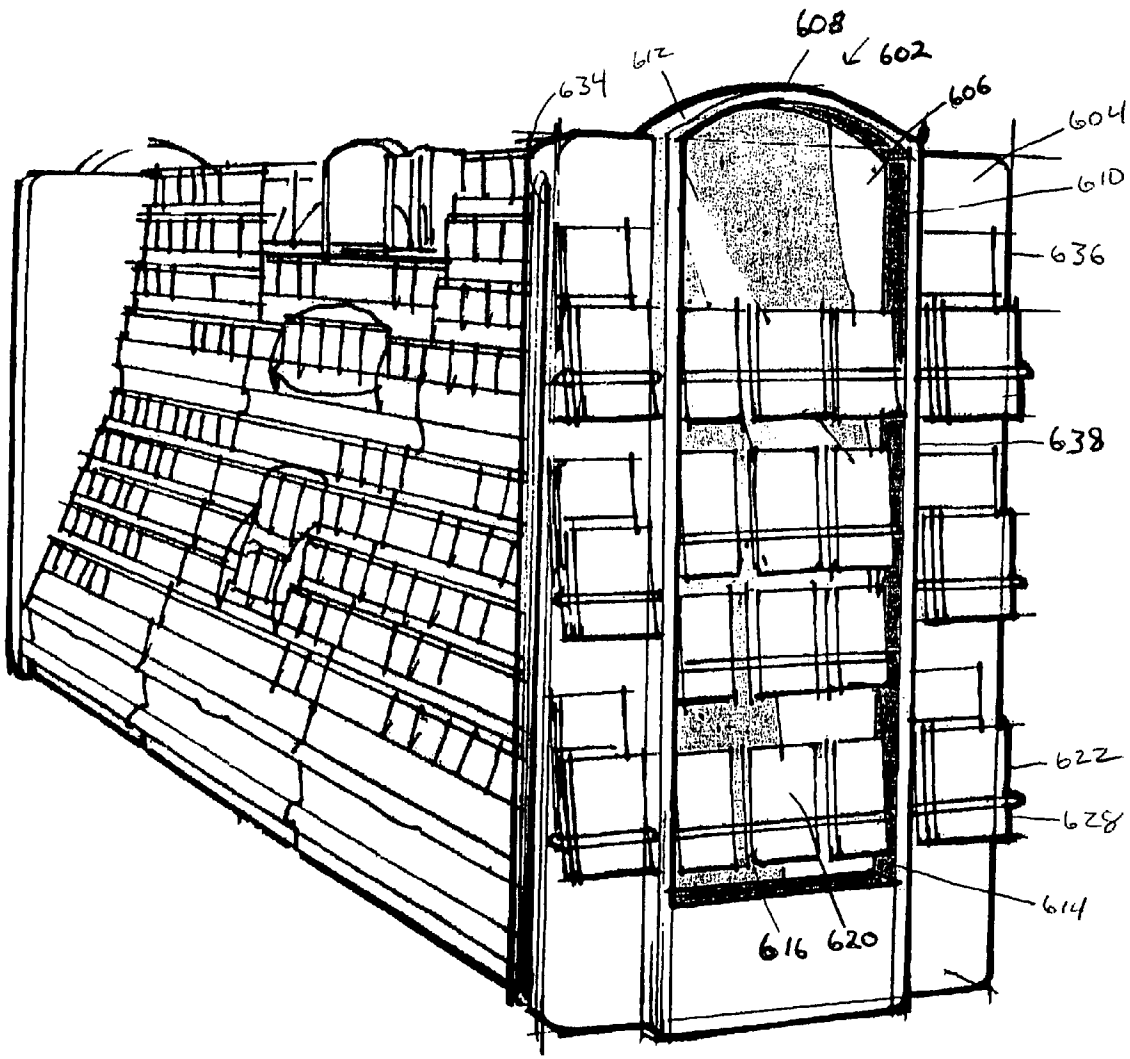
FIG. 6 illustrates a perspective view of an end cap according to another exemplary embodiment of the present invention.

A second exemplary end cap 602 is illustrated in FIG. 6. This exemplary end cap 602 may be attached orthogonally to or placed adjacent to the end of the display rack 104 in a manner similar to the exemplary end cap 502 of FIG. 5. The second end cap 602 includes a first display panel 604 having a substantially rectangular shape. The width of the end cap 602 is substantially equal to the width of the third 112 and fourth 114 horizontal members for the framing system of the display rack 104. The height of the end cap 602 is substantially equal to the height of the display rack 104, including the marquee display panel 302. The end cap 602 also includes a substantially dome-shaped, second display panel 606 having a width substantially equal to half the width of the first display panel 604 and positioned in such a way that it is virtually centered on and positioned in front of the first display panel 604.

The height of the second display panel 606 is substantially equal to the height of the first display panel 604, with the exception that the bottom of the domed portion 608 is positioned at the top of the first display panel 604. The second display panel extends to a center point position having its highest point in the second display panel 606 above that of the highest point of the first display panel 604. The second display panel 606 typically includes a cut-out portion 610 that begins approximately one-quarter of the way up the second display panel 606 and extends upward to the uppermost portion of the dome 608. The depth of the cut out 610 is substantially equal to the depth of the card displays in the first display panel 604. The second display panel 606 can include multiple full-facing card rows 614. Each full-facing card row 614 includes a substantially vertical front member 616, a gently sloping (or horizontal) bottom member 617 (not shown) orthogonal to the plane of the second display panel, and attachment means (not shown) positioned on each of the opposing endpoints of the front member 616 and bottom member 617 for each row.

The second display panel 606 can further include a series of slotted receptacles 618 (not shown) on each of its opposing sides, running in the vertical direction of the panel 606. These slotted receptacles 618 allow the positioning of full-facing card rows 614 at any height selected by the retailer. The slotted receptacles 618 in the vertical direction are capable of receiving tabs (not shown) positioned on the opposing ends of the front 616 and bottom 617 members of the full-facing card rows 614. The front members 616 are generally made of a clear material, such as plastic. In one exemplary embodiment, the second display panel 606 includes four full-facing card rows 614, each row supporting placement of multiple cards on each row 614.

Returning to the first display panel 604 in FIG. 6, the first display panel 604 typically includes double row pockets 622 extending in the horizontal direction along the same plane as the second display panel 606. Each double row pocket 622 is typically positioned outside of the second display panel 606 and near the opposing edges of the first display panel 604. Each double row pocket 622 includes a substantially vertical back member 624 (not shown), a gently sloping (or horizontal) bottom member 626 (not shown) orthogonal to the plane of the first display panel 604 and a substantially vertical (or steeply sloping) front member 628. Each front 628, bottom 626, and back 624 member is configured to create a pocket.

A left-side member 630 and a right-side member 632 may be orthogonally attached to the endpoints of the front 628, bottom 626, and back 626 members for each double row pocket 622. The back member 626 for the lowest row of the double row of pockets 622 acts as the front member 628 for the upper row. In one exemplary embodiment, three sets of double row pockets 622 are positioned on each side of the second display panel 606 and along the first display panel 604 in a vertical manner. In this manner, the bottom row of double row of pockets 622 of the first display panel is substantially equal to the bottom row of full-facing card pockets in the second display panel 606.

The first display panel 604 also includes a left-side light panel 634 and a right-side light panel 636. The left-side light panel 634 is positioned along the left side of and orthogonal to the first display panel 604. The right-side light panel 636 (not shown) is positioned along the right side of and orthogonal to the first display panel 604. The left-side 634 and right-side 636 light panels have a depth and height substantially equal to the depth and height of the first display panel 604. In one exemplary embodiment, the left-side 634 and right-side 636 light panels are made of a material that allows light to pass through it. In one exemplary embodiment, the left-side 634 and right-side 636 light panels are made of acrylic or clear plastic.

The first 604 and second 606 display panels may be made from wood, metal, hardened plastic, or other materials known to those of ordinary skill in the art. Each double row pocket 622 is generally constructed of a clear material, such as plastic. A double row pocket also can be constructed from a metallic material and bolted or welded together. Each double row pocket 622 may be attached to the first display panel 604 by one or more tabs (not shown) attached to the side 630, 632 or back 626 members of the uppermost row of the double row of pockets 622.

The first display panel 604 may also include a series of slotted receptacles (not shown) extending in the vertical direction along the outside edge of the first display panel 604. The receptacles are positioned along the edge formed by the intersection of the second display panel 606 and the first display panel 604. The tabs on the back 626 or side 630, 632 members of the double row of pockets 622 may be slidably inserted into the slotted receptacles. The slots (not shown) in the slotted receptacles support placement of the double row of pockets 622 at a height desirable to the retailer. The exemplary end cap 602 may also include a lighting system (not shown) positioned behind the first 604 and second 606 display panels. The light from the lighting system typically projects filtered mood light through the second display panel 606 and the left-side 634 and right-side light panels to highlight the end cap 602 and provide eye catching appeal to consumers.

F. Light-Box End Cap

Figure 7:
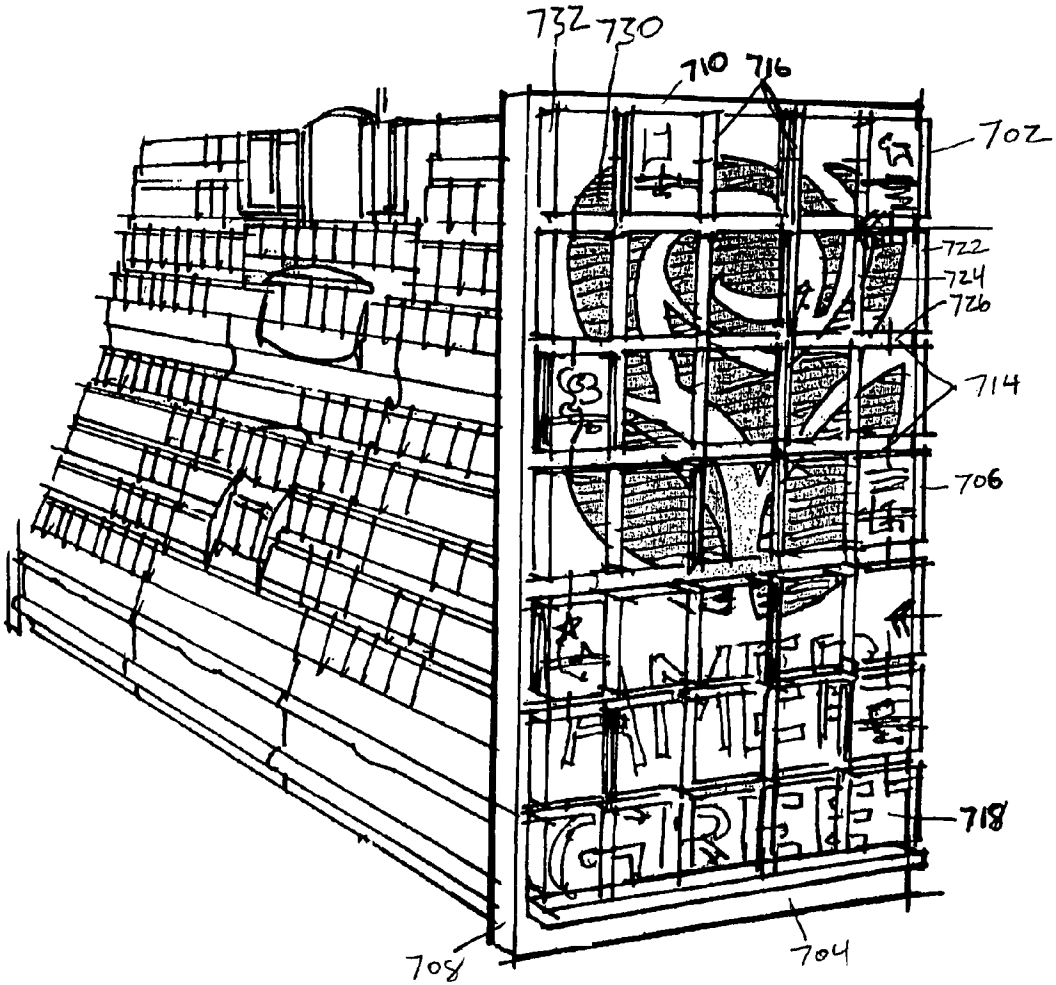
FIG. 7 illustrates a light-box end cap according to one exemplary embodiment of the present invention.

FIG. 7 provides detailed drawings of a third exemplary end cap 702 that may be attached to an endpoint or positioned perpendicular of the display rack 104. The third exemplary end cap 902 includes a first horizontal member 704 acting as the base of the end cap and having a width substantially equal to the width of the third and fourth horizontal members 112, 114 on the framing of the display rack 104. A first vertical member 706 is orthogonally attached at one endpoint of the first horizontal member 704 and a second vertical member 708 is orthogonally attached at the opposing endpoint to the first horizontal member 704. Each vertical member 706, 708 extends upward from the first horizontal member 704 to a height substantially equal to the height of the display rack 104 (including a marquee display panel 302). A second horizontal member 710 is orthogonally attached to the first vertical member 706 at its opposing endpoint and the second vertical member 708 at its opposing endpoint. In this manner, the first 706 and second 708 vertical members and first 704 and second 710 horizontal members create a substantially rectangular shape. The first 704 and second 710 horizontal members and the first 706 and second 708 vertical members typically have a depth capable of supporting an area whereby electronics (not shown) may be placed within the framing of the end cap display 702.

The end cap 702 also includes horizontal members 714 orthogonally attached at each endpoint to the first 706 and second 708 vertical members and spaced vertically along the distance of the first 706 and second 708 vertical members. The exemplary end cap 702 also includes vertical members 716 orthogonally attached at opposing endpoints to the first 704 and second 710 horizontal members and spaced horizontally along the distance of the first 704 and second 710 horizontal members and interlocking with the horizontal members 714. This creates a checkerboard-type design. Each checkerboard square 718 in the exemplary end cap 702 is suitable to receive and hold a greeting card or a graphic 730.

For checkerboard squares 718 holding one or more greeting cards, a front member 720 (not shown) may be attached to the right-side 722, left-side 724, and bottom 726 members for each checkerboard square 718. The front member extends substantially in the vertical direction along a portion of the checkerboard square's 718 vertical distance. This allows the insertion of greeting cards into a pocket created by the front 720, bottom 726, right 722, and left-side 724 members for that checkerboard square 718.

Other checkerboard squares 718 may not have a front member 720. This allows the graphic 712 to be displayed. For checkerboard squares 718 displaying a graphic 730, a back box 728 (not shown) having dimensions substantially similar to the dimensions of the checkerboard square 718 is slidably inserted into the checkerboard square 718. Next, a graphic 730 having dimensions substantially similar to the dimensions of the checkerboard square 718 is placed up against the front side of the back box 728. A front box 732, having dimensions substantially similar to the dimensions of the checkerboard square 718 is slidably inserted into the square 718, such that the graphic 730 is compressed and held between the back box 728 and the front box 732. The back box 728, graphic 730, front box 732, front member 720, and the members 714, 716 are typically made of a clear material, such as plastic. A lighting system (not shown) is typically included behind the graphic 730 to highlight the graphic 730 and provide eye catching appeal to consumers. The first 704 and second 710 horizontal members and the first 706 and second 708 vertical members are typically made of an opaque material such as wood, metal, or hard plastic.

The fixtures shown in FIGS. 1-10 are designed to attract consumers to the card display area and induce an impulse buy from that consumer. In addition, the fixtures are designed to assist in the cross marketing of card purchases for multiple occasions, thereby inducing a person entering the card display area with the intention of buying one card to purchase additional cards.

II. Method of Marketing Greeting Cards

The exemplary end cap 502 of FIG. 5 can be placed on one or both ends of the card display rack 104 in order to attract a consumer's attention to the card display area. The end cap 502 provides the consumer with a "store-window" type view of the card retail area, similar to the manner that windows of a retail store may be "dressed up" to attract patrons into the store. The window box graphic 522 is oversized in relation to the overall size of the end cap 502 and is intended to attract the attention of the consumer from a great distance. When a consumer approaches the card retail area, they are presented with a special assortment of cards displayed in the pockets of the end cap 502. These cards typically have eye catching, contrasting colors meant to draw the consumer's eye. The cards are rotated on a frequent basis to provide the consumer with a variety of card views over a period of shopping experiences in the greeting card area. In general, the display of cards on the end cap 502 is similar to the presentation of cards in the card display rack 104, thereby presenting the consumer with a hint of what is to come if they enter the card retail area.

In addition, these cards are typically displayed on the end cap 502 in a manner and are generally of the type that induce an impulse buy. A majority of the cards displayed at the end cap 502 are full-facing, meaning that the consumer does not have to remove the card from its pocket to see the front of the card. A display of full-facing cards is intended to save the consumer time and improve the shopping experience. Full-facing cards also promote the artistic value of the cards. Inducing an impulse buy can be significant because the selection of the card may induce the consumer to enter further into the card retail area. On the other hand, inducing an impulse buy also generates a sale from consumers who may not have otherwise entered the card retail area because of time or other constraints.

An occasion title, or category, such as Birthday, Anniversary, or Wedding, is typically provided on the graphic 308 at the marquee display panel 302. Card purchasing consumers have been conditioned over the years to immediately focus their attention at or above eye level to locate the occasion of cards they are searching for in a display. Each occasion is preferably designated a specific color (i.e. blue for Birthday and purple for Wedding). Each color has been chosen for its ability to further evoke emotions related to the particular occasion. The graphic 308 on the marquee display panel 302 is typically made of an acrylic, semi-translucent material and is substantially dome-shaped. The name of the occasion is printed on the semi-translucent acrylic in a dark shade of the chosen color for the occasion. The dark shade increases the ability to attract the consumer's attention to that occasion. The caption locator cards, which are typically located behind each card in the pocket, provides major and minor subheadings for each occasion (i.e. Birthday for Him or Birthday for Him/Funny). The caption locator cards for each occasion will typically have the same color, but lighter shade, as the color selected for the occasion. This will provide a visual cue to the consumer if they stray from a display area for their intended card occasion. In addition, some caption locator cards may not have the same color as the occasion title. Instead, these cards may have a color that is complimentary to the color chosen for the particular occasion (i.e. yellow for Birthday and pink for Wedding). The complimentary color will signal to the consumer that the cards in front of a particular caption locator deserve special attention during card browsing activity.

The dome-shape of the occasion graphic 308 provides a soft, comfortable feel to the consumer and draws her eye downward to induce a card sale at the card display rack 104. As the consumer's eye drifts downward, a series of shadowboxes 106 interspersed with graphic display panels 148 are provided substantially at the consumer's eye level. A design of text, graphics, or both are provided on the graphic display 148 to create an emotional response in the consumer. The objective of this design is to encourage the consumer to enter a card-buying mood and increase the likelihood that they will purchase one or more cards. While the text or graphics in the graphic display 148 may be related to the occasion, such as candles and presents for the "Birthday" occasion, the text will generally not be the name of the occasion itself.

Now that the consumer has had their emotional volume turned-up, her attention can be attracted towards the shadowboxes 146. The shadowboxes 146 contain an assortment of cards that telegraph the occasion. These full-facing cards telegraph the occasion because the ordinary consumer can determine the occasion of the card by viewing the graphics on the front of the card in the shadowbox 146 and will not need to look-up at the marquee display panel 302. The cards in the shadowboxes 146 are sometimes in matched pairs, one on each side of the graphic display panel 148, each having the same graphic design on the front of the card but typically meant for the opposite sex (i.e. birthday for her and birthday for him). The presentation of greeting cards in the shadowboxes 146 provides an opportunity to stir additional emotional feelings, thereby increasing the opportunity for a sale to a consumer as their eye travels slowly down the card display rack 104.

As the consumer's attention travels downward into the main card display area of the card display rack 104, a first series of cards is provided above the caption strip 174. The caption strip 174 provides visual relief from a sea of cards and assists the consumer in locating the occasion for the cards. The cards above the caption strip 174 are typically full-facing, allowing the consumers to view the entire front of a card without having to remove the card from the pocket, thereby allowing her to see more cards in the same amount of time. A-SKU level cards are generally presented in the A-SKU highlighters 178, 186 above the caption strip 174. The A-SKU level cards tend to be trendier, newer, and more likely to be on the cutting edge. They will tend to have brighter, more vibrant colors and will be rotated from the card display rack 104 on a more frequent basis than the cards in the remainder of the display rack 104.

The card highlighter area 178, 186 attracts the eye of the consumer to that area because it is different than the standard card display rack 104. In one exemplary embodiment, the card highlight area 178, 186 can be a flat row of cards set apart through the use of a different set of graphics 186. In the alternative, the card highlight area 178, 186 can be a three dimensional row that appears to reach out to the consumer 178, as described in FIG. 2. Cards placed in these highlighters 178, 186 tend to be even more vibrant and trendier in relation to the occasion that the other cards above the caption strip 174 and are more likely to generate an impulse buy from the consumer.

Cards on the row immediately above the caption strip 174 and not in the A-SKU highlighters are typically B-SKU level cards. B-SKU level cards are not quite as trendy and daring as the A-SKU level cards but they do illustrate emerging trends related to the particular occasion. The remaining cards above the caption strip 174, including the shadowboxes 146 are typically C-SKU level cards. C-SKU level cards typically include cards that have been displayed previously and have garnered strong sales. Cards positioned above the caption strip 174 are also more likely to induce an impulse buy, based on the emotion created by the graphics 148, 308, the shadowboxes 146, the cards in the A-SKU highlighters 178, 186, and the freshness of the displayed card content.

As the consumer's attention slowly scans downward below the caption strip 174, a second series of cards is displayed. The cards below the caption strip 174 typically are partially-facing, meaning that the consumer will have to remove the card from the pocket in order to view the full front of the card. The area below the caption strip 174 typically includes one or more B-SKU level highlighters 198, 404. The B-SKU level highlighters 198, 404 generally present B-SKU level cards in a full-faced manner. The B-SKU level cards in the highlighters 198, 404 that visually signal a newness across a breadth of occasions and consumer lifestyles. The B-SKU level cards are not quite as trendy and daring as the A-SKU level cards but they do illustrate emerging trends related to the particular occasion.

The B-SKU card highlight areas 198, 404 attract the eye of the consumer to that area because is the highlighter 198, 404 is different from the standard card display rack 104. For instance, the B-SKU highlighter areas 198, 404 are the only areas below the caption strip 174 that present cards in a full-facing manner. The card highlight area 198 can be two flat rows of cards set apart by making them full-facing and using a different set of graphics 198. In the alternative, the card highlight area 404 can be a three dimensional series of rows, such as a conical shape that appears to reach-up to the consumer 404, as described in FIG. 4.

The cards placed in the card highlight area below the caption strip 174 are generally grouped under a specific theme for that occasion. Themes may include a funny theme. For example, clay animation characters may be attached to the highlighter 174 and the cards in the highlighter 174 may include jokes related to the clay animation characters. Another example of a theme includes cards based on famous actors, entertainers, or popular television shows. The graphics in the highlighter 174 could be related to the theme and the cards provided in the highlighter 174 could include lines attributable to or comments regarding the actor, entertainer, or television show.

If the consumer still has not decided on a card for the particular occasion as her eye travels further downward, C-SKU level cards are generally presented below the caption strip 174 and outside of the highlighter areas 198, 404. The C-SKU level cards include a full-facing row of cards at the bottom of the display 104. By combining the eye catching appeal of full-facing cards with a series of cards that have a prior track record for strong sales, a final attempt is made to secure the sale of a card for that occasion.

Figure 11:
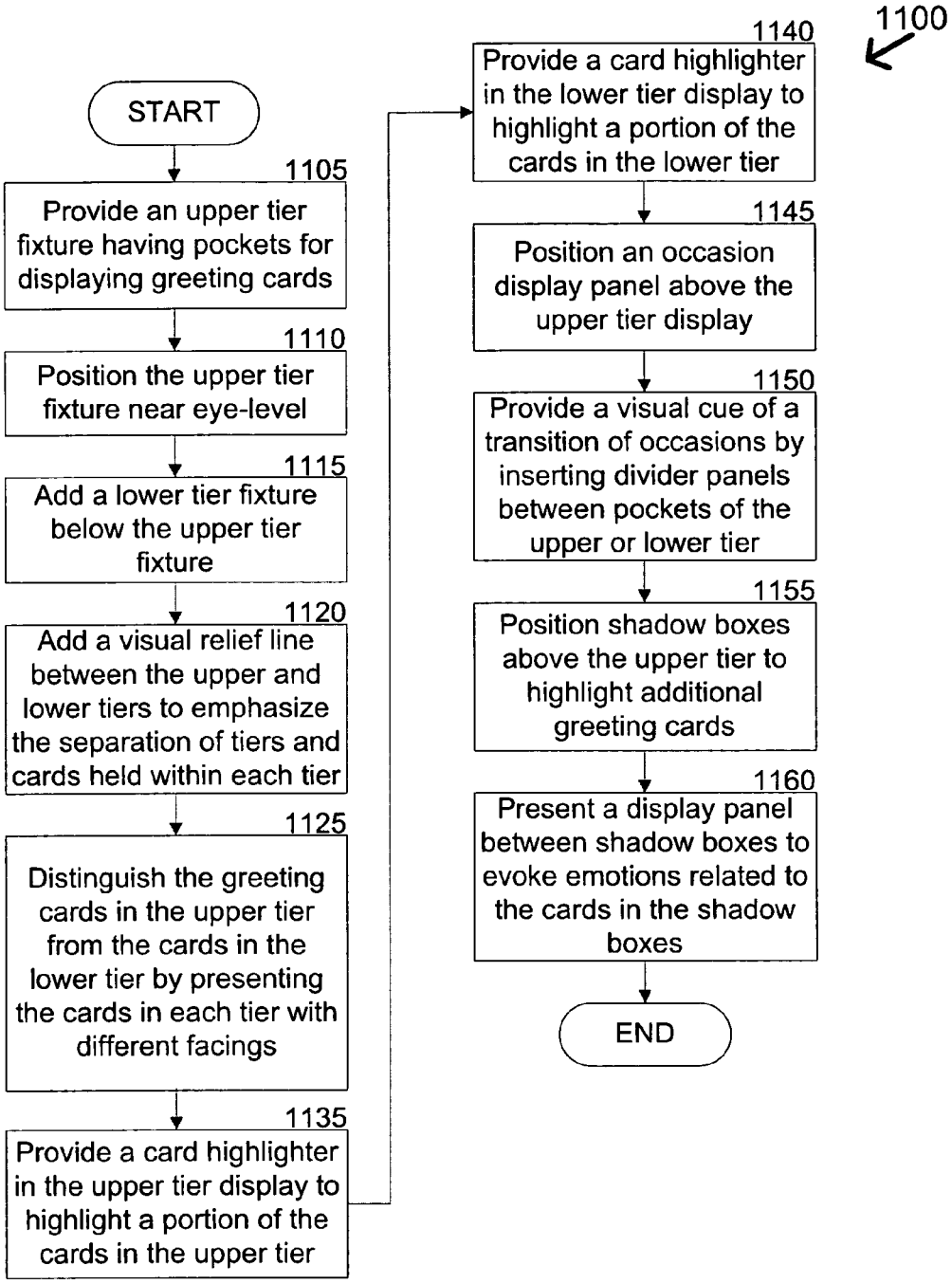
FIG. 11 is a flowchart illustrating a process for distinguishing greeting cards based on the manner of display in accordance with an exemplary embodiment of the present invention.
Figure 12:
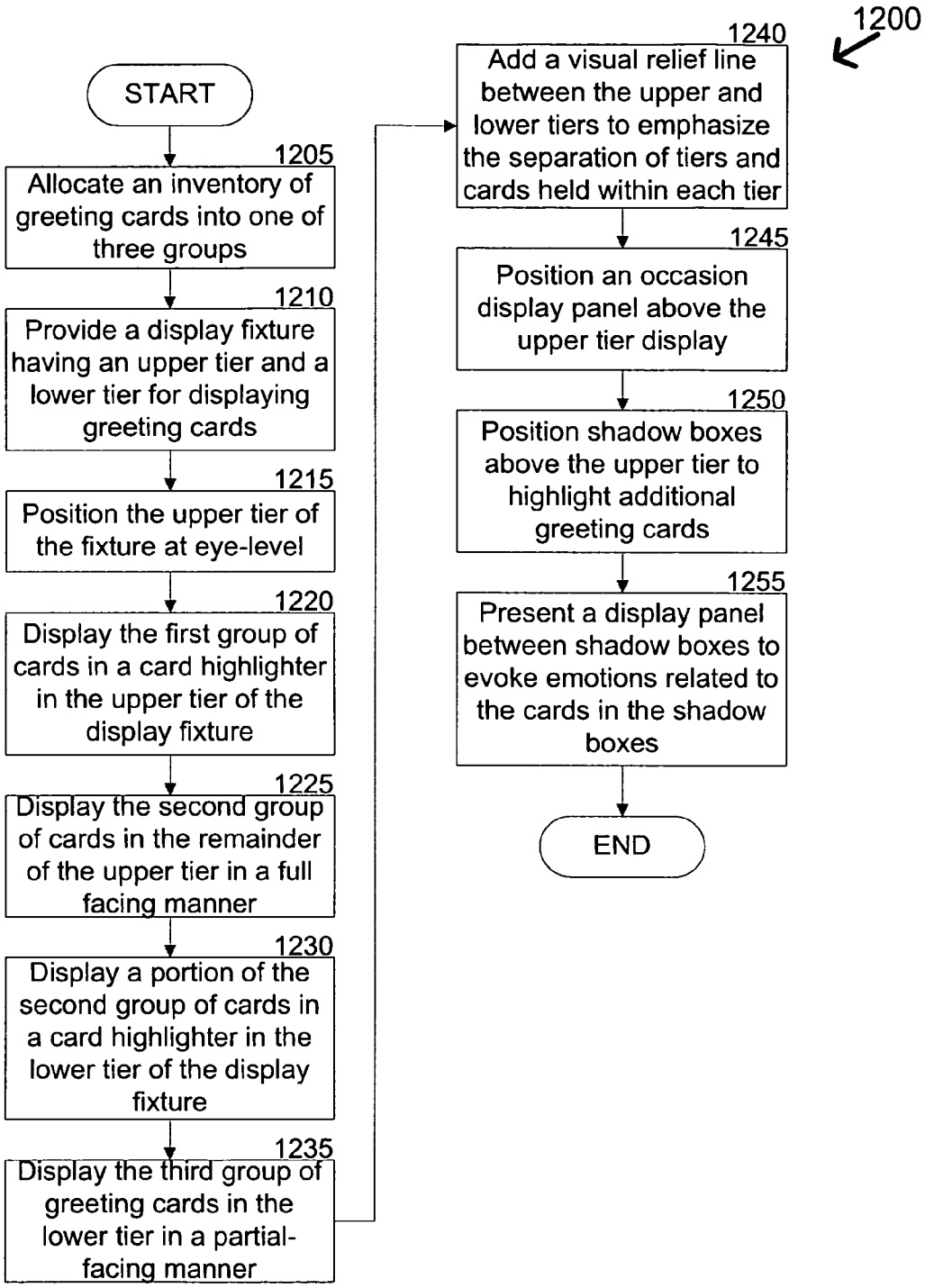
FIG. 12 is a flowchart illustrating a process for organizing an inventory of greeting cards into groups based on card characteristics and displaying those cards in specific areas of the display based on grouping in accordance with an exemplary embodiment of the present invention.
Figure 13:
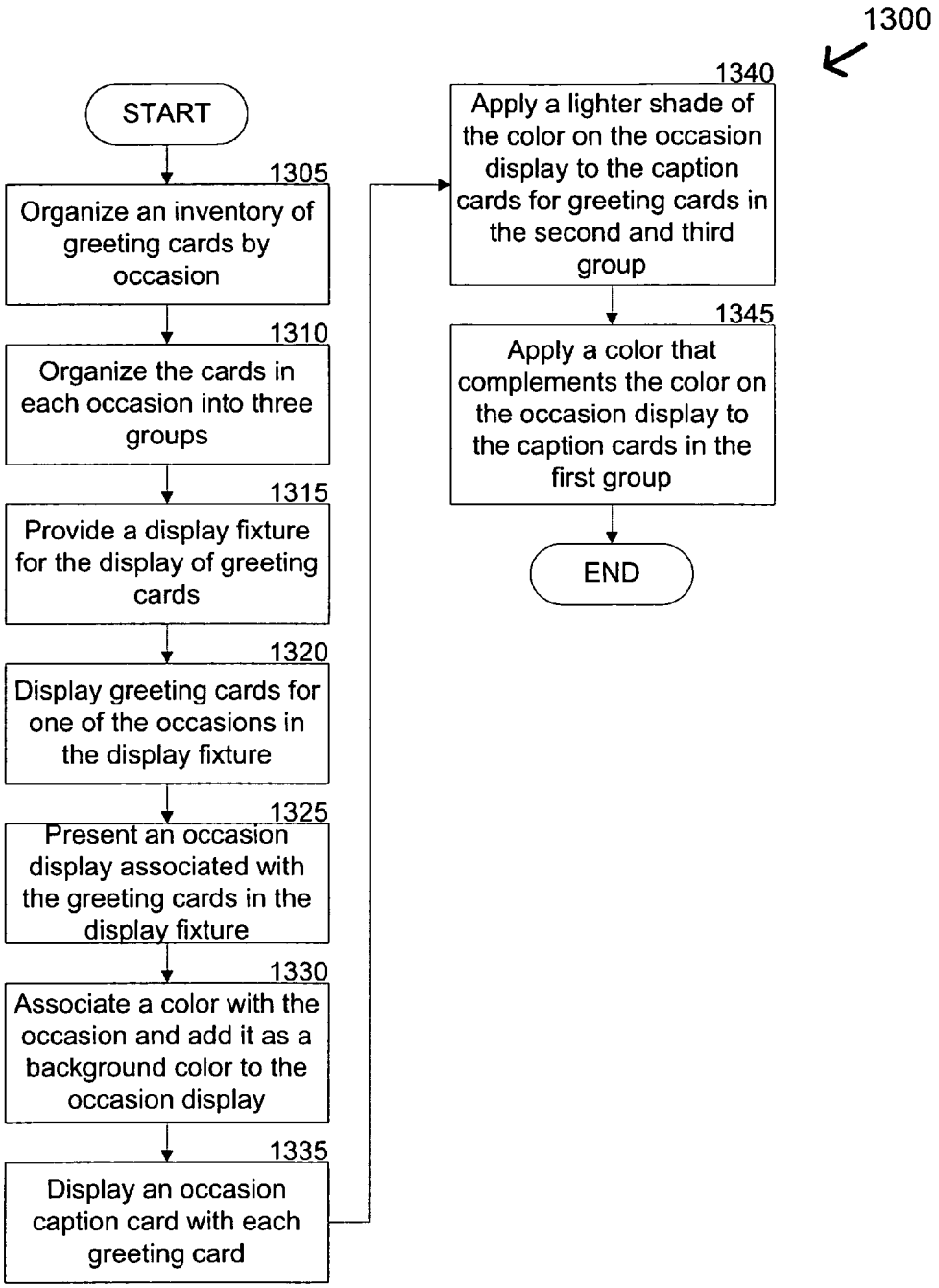
FIG. 13 is a flowchart illustrating a process for organizing an inventory of greeting cards into groups based on card characteristics and providing color coordinated caption cards based on grouping in accordance with an exemplary embodiment of the present invention.

FIGS. 11-13 are logical flowchart diagrams illustrating the processes for organizing and displaying greeting cards. FIG. 11 is a logical flowchart diagram presented to illustrate the steps of an exemplary process 1100 for distinguishing greeting cards based on the manner of display within the representative display fixture 100 of FIG. 1. Now referring to FIG. 11, the exemplary method 1100 begins at the START step and proceeds to step 1105, where an upper tier fixture having multiple rows of pockets for displaying greeting cards is provided. The upper tier is positioned substantially at eye-level for the average greeting card consumer in step 1110. In step 1115, a lower tier fixture is added to the upper tier fixture. In one exemplary embodiment, the lower tier fixture is positioned below the upper tier fixture.

A visual relief line is positioned between the upper and lower tier fixtures in step 1120. The visual relief line emphasizes the separation between the upper and lower tier to the consumer and provides a momentary break or rest for the eyes of the consumer as he or she scans the fixture. In step 1125, the greeting cards in the upper tier are distinguished from the greeting cards in the lower tier by the manner in which the cards are presented. In one exemplary embodiment, cards in the upper tier are displayed in a full-facing manner so that the entire front of the card may be viewed as it sits in the display, while the cards in the lower tier are displayed in a partial-facing manner, so that only a portion of the front of the greeting card is viewable as it sits in the lower tier display. In this exemplary embodiment, the cards in the bottom row of the lower tier can be presented in a full-facing manner while the remainder of the cards in the lower tier are presented in a partial-facing manner.

In step 1130, a card highlighter is positioned along one of the rows of the upper tier. The card highlighter highlights the cards presented therein and attracts the attention of the consumer to induce an impulsive purchase. Another card highlighter is positioned along one of the rows of the lower tier to highlight another set of greeting cards in step 1135. In step 1140, an occasion display panel is positioned above the upper tier display. The occasion display panel presents information that identifies one or more occasions for greeting cards presented in the upper and lower tiers.

In step 1145, divider panels are positioned between pockets along the rows of the upper and lower tiers of the display to provide a visual cue to a consumer that they are transitioning from cards associated with one occasion to cards associated with another occasion. Shadowboxes are positioned above the upper tier to highlight additional greeting cards and to attract the eye of the consumer in step 1150. In step 1155, a display panel is provided between two of the shadowboxes. The display panel is designed to evoke emotions related to the greeting cards presented in the shadowbox displays. The process continues from step 1155 to the END step.

FIG. 12 is a logical flowchart diagram presented to illustrate the steps of an exemplary process 1200 for organizing an inventory of greeting cards into groups based on card characteristics, such as trendiness, and displaying those cards in specific areas of the display based on grouping within the representative display fixture 100 of FIG. 1. Referring to FIG. 12, the exemplary method 1200 begins at the START step and proceeds to step 1205, where an inventory of greeting cards is analyzed and allocated into one of three groups. In one exemplary embodiment, the three groups are a first group that includes A-SKU level cards, a second group that includes B-SKU level cards, and a third group that includes C-SKU level cards. The A-SKU level cards tend to be trendier, newer, and more likely to be on the cutting edge. A-SKU level cards have brighter, more vibrant colors and will be rotated from the card display on a more frequent basis than the cards in the remainder of the display. B-SKU level cards are not quite as trendy and daring as the A-SKU level cards but they do illustrate emerging trends related to a particular occasion. C-SKU level cards typically include cards that have been displayed previously and have garnered strong sales.

In step 1210, a greeting card display fixture having an upper tier and a lower tier is provided in a card retail area. The upper tier of the display is positioned at eye-level for the average greeting card consumer in step 1215. In step 1220, the first group of cards is displayed in a card highlighter positioned along one of the rows of the upper tier of the display. A portion of the second group of greeting cards is displayed in a portion of the pockets in the upper tier in a full-facing manner in step 1225. In step 1230, another portion of the second group of cards is displayed in a card highlighter positioned along one of the rows of the lower tier of the display. The third group of greeting cards is displayed in a partial-facing manner in the remaining rows of pockets in the lower tier of the display in step 1235.

In step 1240, a visual relief line is provided between the upper and lower tiers of the display to emphasize the separation of the tiers and to distinguish between the cards held in each tier. In step 1245, an occasion display panel is positioned above the upper tier display. The occasion display panel presents information that identifies one or more occasions for greeting cards presented in the upper and lower tiers. Shadowboxes are positioned above the upper tier and another portion of the third group of greeting cards is inserted therein to highlight additional greeting cards and to attract the eye of the consumer to certain of the third group of greeting cards in step 1250.

In one exemplary embodiment, greeting cards organized into groups based on different card characteristics may be displayed in the exemplary fixture 100. The card characteristics that can be used to organize the cards includes, but is not limited to, the artistic designs on the front, back and inside of the greeting card, the design of the card, the copy on the front and inside of the card, the style of the card, the sales history of the card, the card's association with current or emerging trends, and various other aspects of the card. As described above, A-SKU level cards are positioned in the upper tier highlighter along the bottom row of the upper tier in a full-facing manner. B-SKU level cards are displayed on the lowest row of pockets in the upper tier other than where the highlighter(s) have been positioned. B-SKU level cards can also be displayed in highlighters positioned in the lower tier. C-SKU level cards are displayed in the remaining rows of pockets in the upper and lower tiers and, if attached, in the shadowboxes positioned above the upper tier of the display fixture 100. In step 1255, a display panel is provided between two of the shadowboxes. The display panel is designed to evoke emotions related to the greeting cards presented in the shadowbox displays. The process continues from step 1255 to the END step.

FIG. 13 is a logical flowchart diagram presented to illustrate the steps of an exemplary process 1300 for organizing an inventory of greeting cards into groups based on card characteristics, such as trendiness, and providing color coordinated caption cards based on their grouping within the display fixture 100 of FIG. 1. Now referring the FIG. 13, the exemplary method 1300 begins at the START step and proceeds to step 1305, where an inventory of greeting cards is organized by greeting card occasion. In step 1310, an inventory of greeting cards for a greeting card occasion is analyzed and allocated into one of three groups. In one exemplary embodiment, the three groups are the same as those described above for step 1205 of FIG. 12. In step 1315, a greeting card display fixture having an upper tier and a lower tier is provided in a card retail area.

The three groups of greeting cards are displayed in the display fixture in step 1320. In one exemplary embodiment, the organization of the groups of greeting cards in the display fixture is the same as described in steps 1220-1235 of FIG. 12. In step 1325, an occasion display panel is positioned above the upper tier display. The occasion display panel presents information that identifies one or more occasions for greeting cards presented in the upper and lower tiers. A color is associated with each greeting card occasion (i.e. blue for Birthday and purple for Wedding) and the color is added as a background to the occasion display panel in step 1330. In one exemplary embodiment, each color is chosen for its ability to further evoke emotions related to the particular occasion.

In step 1335, occasion caption cards are provided in each of the pockets of the display fixture. For caption cards in pockets where the second and third group of greeting cards are being displayed, a lighter shade of the color applied to the occasion display panel is applied to the caption cards in step 1340. This will provide a visual cue to the consumer if they stray from a display area for their intended card occasion. In step 1345, a complementary color to the color applied to the occasion display panel (i.e. yellow for Birthday and pink for Wedding) is applied to the occasion caption cards that are located in pockets that are displaying cards organized into the first group. The complimentary color will signal to the consumer that the cards in front of a particular caption locator deserve special attention during the card browsing activity. The process continues from step 1345 to the END step.

While there have been shown and described several exemplary embodiments of the present invention, it will be evident to those skilled in the art that various modifications and changes may be made thereto without departing from the spirit and the scope of the present invention.

We claim:

1. A display fixture for the display of greeting cards, comprising:

an upper tier display and a lower tier display positioned below the upper tier display, each of the lower and upper tier displays supported by a supporting structure and comprising a plurality of rows operative to hold the greeting cards, wherein each of the plurality of rows comprises at least one base extending outward from the respective tier display for supporting the greeting cards;

a card highlighter display positioned along at least one of the rows to highlight each of the greeting cards placed within the card highlighter display, the card highlighter display comprising a base providing a bottom support for displaying the greeting cards disposed adjacent the base of the row the card highlighter display is positioned along, wherein the base of the card highlighter display protrudes outward from one of the tier displays at a distance greater than the base for the row the card highlighter display is positioned along to attract a consumer's attention to the greeting cards placed within the card highlighter display, and wherein the base of the card highlighter display is at substantially the same vertical position as the base for the row the card highlighter display is positioned along to display greeting cards in the row and the card highlighter display at substantially the same vertical position;

the rows in the upper tier display capable of displaying a portion of the greeting cards in a full-facing manner to display the full face of each greeting card; and the rows in the lower tier display, other than a bottom row in the lower tier display, capable of displaying another portion of the greeting cards in a manner other than the full-facing manner.

2. The fixture of claim 1, further comprising a horizontal area void of greeting cards positioned between the upper tier display and the lower tier display and extending substantially across the full width of the fixture, the spacing serving as a visual guide for a consumer to distinguish between the upper tier display and the lower tier display.

3. The fixture of claim 1, further comprising a display panel positioned generally above the upper tier display, the display panel presenting content for identifying a greeting card occasion for the greeting cards displayed in the upper tier display and the lower tier display.

4. The fixture of claim 1, further comprising at least one shadowbox display holder positioned generally above the upper tier display, each shadowbox display holder comprising:

a substantially rectangular border comprising:

a first and a second vertical side member;

a top member coupled to the first and the second vertical side members; and a back panel coupled to at least one of the top member and the first and the second vertical side members;

wherein the top member, back panel, first vertical side member and the second vertical side member define a box having a depth capable of receiving a greeting card therein.

5. The fixture of claim 4, further comprising a display panel positioned generally above the upper tier display and positioned adjacent to the shadowbox display holder, the display panel presenting content designed to evoke emotions associated with the greeting card presented by the shadowbox display holder.

6. The fixture of claim 1, wherein the bottom row of pockets in the lower tier display are capable of displaying another portion of the greeting cards in a manner other than the full-facing manner.

7. A display apparatus for the display of greeting cards, comprising:

an upper tier display and a lower tier display positioned below the upper tier display, each of the lower and upper tier displays comprising pockets operative to hold the greeting cards, each pocket comprising a base extending outward from the respective tier and providing a bottom support for displaying greeting cards, the pockets in the upper tier display capable of displaying a portion of the greeting cards in a full-facing manner to display the full face of each greeting card, the pockets in the lower tier display, other than a bottom row of pockets in the lower tier display, capable of displaying another portion of the greeting cards in a manner other than the full-facing manner, wherein a presentation of the greeting cards with different facings within the pockets of the upper and lower tier displays serves as a visual guide for a consumer to distinguish between the greeting cards held in the upper tier display and the lower tier display; and a card highlighter display positioned along at least one of the rows of the pockets of the upper tier display and adjacent to certain pockets to highlight each of the greeting cards placed within the card highlighter display, the card highlighter display comprising a base providing a bottom support for displaying the greeting cards disposed on the base of the at least one rows of the pockets the card highlighter display is positioned along, wherein the card highlighter base extends outward from the upper tier to a distance greater than the base of the adjacent pockets, wherein the card highlighter display replaces at least a portion of the pockets of at least one row of pockets of the upper tier display and wherein the base of the card highlighter display is at substantially the same vertical position as the base for the adjacent pockets to display greeting cards in the adjacent pockets and the card highlighter display at substantially the same vertical position.

8. The apparatus of claim 7, further comprising a horizontal area void of greeting cards and comprising a graphic extending across substantially the full width of the fixture and positioned between the upper tier display and the lower tier display, the area emphasizing a separation between the upper tier display and the lower tier display and serving as a visual guide for a consumer to distinguish between the upper tier display and the lower tier display.

9. The apparatus of claim 7, further comprising a display panel positioned generally above the upper tier display, the display panel presenting content for identifying a greeting card occasion for the greeting cards displayed in the upper tier display and the lower tier display.

10. The fixture of claim 7, further comprising at least one shadowbox display holder positioned generally above the upper tier display, each shadowbox display holder comprising:

a substantially rectangular border comprising:

a first and a second vertical side member;

a top member coupled to the first and the second vertical side members; and a back panel coupled to at least one of the top member and the first and the second vertical side members;

wherein the top member, back panel, first vertical side member and the second vertical side member define a box having a depth capable of receiving a greeting card therein.

11. The fixture of claim 10, further comprising a display panel positioned generally above the upper tier display and positioned adjacent to and between at least two shadowbox display holders, the display panel presenting content designed to evoke emotions associated with each greeting card presented by the shadowbox displays.

12. The fixture of claim 7, wherein the bottom row of pockets in the lower tier display are capable of displaying another portion of the greeting cards in a manner other than the full-facing manner.

13. The fixture of claim 7, further comprising another card highlighter display positioned along at least one of the rows of the pockets of the lower tier display and adjacent to certain pockets to highlight each of the greeting cards placed within the other card highlighter display, the card highlighter display comprising a base providing a bottom support for displaying the greeting cards, wherein the card highlighter base extends outward from the upper tier to a distance greater than the base of the adjacent pockets, wherein the card highlighter display replaces at least a portion of the pockets of at least one row of pockets of the upper tier display and wherein the base of the card highlighter display is at substantially the same vertical position as the base for the adjacent pockets to display greeting cards in the adjacent pockets and the highlighter at substantially the same vertical position.

14. The fixture of claim 7, wherein the pockets in the upper tier display present a first portion of the greeting cards in a full-facing manner and a second portion of the greeting cards in a partial-facing manner.

15. A display for presenting greeting cards, comprising:

a display fixture comprising an upper display and a lower display positioned below the upper display, each of the lower and upper displays comprising pockets operative to hold a portion of the greeting cards;

a card highlighter display positioned along at least one of the pockets of the upper tier display and adjacent to certain of the pockets to highlight each of the greeting cards placed within the card highlighter display, the card highlighter display replacing the at least one pocket of the upper tier display and configured such that the greeting cards placed within the card highlighter display are displayed at substantially the same vertical position as greeting cards held in the certain pockets adjacent to the card highlighter display; and an endcap display, positioned adjacent to one end of the display fixture, comprising:

a display panel comprising a front side and a back side, the first display panel positioned substantially orthogonal to the display apparatus and comprising pockets supported by the front side and operative to hold another portion of the greeting cards; and a side display panel positioned substantially orthogonal to the display panel and extending from the back side of the display panel, the side display panel comprising pockets operative to hold a remaining portion of the greeting cards, the pockets of the display panel and the side display panel capable of presenting the greeting cards in a full-facing manner to display the full face of each greeting card.

16. The display of claim 15, further comprising a second side panel, positioned substantially orthogonal to the display panel and extending from the back side of the display panel, the second side panel placed parallel to and spaced-apart from the side panel, the second side panel comprising pockets operative to hold another portion of the greeting cards.

17. The display of claim 15, further comprising a barrier positioned between the display fixture and the side panel, at least a portion of the barrier extending above a plane of the side panel and the display fixture, the barrier providing a visual cue to a consumer of a transition point between the display fixture and the endcap display.

18. The display of claim 15, wherein:

the pockets in the upper display are capable of displaying a portion of the greeting cards in a full-facing manner to display the full face of each greeting card; and the pockets of the lower display, other than a bottom row of pockets in the lower display, are capable of displaying another portion of the greeting cards in a manner other than the full-facing manner.

19. The display of claim 15, further comprising:

at least a pair of shadowbox displays positioned generally above the upper display for telegraphing a greeting card occasion, each shadowbox display capable of displaying at least one of the greeting cards having a greeting card face comprising graphics readily recognizable by a consumer as being related to the greeting card occasion; and a display panel positioned generally above the upper display and positioned between the pair of shadowbox display holders, the display panel presenting content designed to evoke emotions associated with each greeting card presented by the shadowbox displays.

20. The display of claim 15, further comprising:

a horizontal spacing configured to not present greeting cards positioned between the upper display and the lower display, the spacing serving as a visual guide for a consumer to distinguish between the upper display and the lower display; and a second display panel positioned generally above the upper display, the second display panel presenting content for identifying a greeting card occasion for the greeting cards displayed in the upper display and the lower display.

21. The fixture of claim 1, wherein the base for the card highlighter display is at substantially the same vertical position as the base for the row the card highlighter display is positioned along to display greeting cards in the row and the highlighter display at substantially the same vertical position.

22. The fixture of claim 21, wherein the card highlighter display comprises:

a back member; and at least two vertical card dividers, each divider coupled along a first vertical side to the back member and extending in a vertical direction and outward from the back member to provide a separation between greeting cards placed within the card highlighter display and the greeting cards held in the row the card highlighter display is positioned along.

23. The fixture of claim 22, wherein the back member comprises a convex shape that extends outward from the row the card highlighter display is positioned along to a distance greater than the base of the row the card highlighter display is positioned along.

24. The fixture of claim 22, wherein the card highlighter display further comprises a substantially clear front member coupled to each of the vertical card dividers along a second vertical side opposite the first vertical side.

25. The fixture of claim 1, wherein the card highlighter display displays greeting cards in a full-facing manner.

26. The fixture of claim 1, wherein each row comprises a plurality of shams and wherein the card highlighter display is slidably inserted into one or more shams of at least one row.

27. The fixture of claim 1, wherein each row further comprises a back panel and wherein the card highlighter display comprises a back panel, wherein the back panel of the card highlighter display is positioned in front of the back panel of the row the card highlighter display is positioned along to display greeting cards in the card highlighter display in a position further from the back panel of the row than that of the greeting cards held within the row the card highlighter is positioned along.

28. The fixture of claim 1, wherein the rows in the upper tier display are further capable of displaying a second portion of the greeting cards in a partial-facing manner.

29. The fixture of claim 28, wherein each row comprises a plurality of pockets, each pocket configured to present a greeting card.

30. The fixture of claim 29, wherein at least a portion of the pockets in the upper tier are arranged in vertical columns and wherein the pockets in the upper tier display are configured to display each greeting card in a first portion of the columns in a full-facing manner and configured to display each greeting card in a second portion of the columns in a partial-facing manner to display only a portion of the greeting card face.

31. The fixture of claim 1, further comprising at least one shadowbox display holder disposed above the upper tier display, wherein each shadow box display holder comprises:

a substantially horizontal bottom member orthogonally connected to a first substantially vertical member and a second substantially vertical member extending upward from the bottom member;

a back member orthogonally connected to back sides of the bottom member, the first substantially vertical member and the second substantially vertical member; and a front member orthogonally attached to the first substantially vertical member extending vertically from the bottom of the first substantially vertical member and extending horizontally along the bottom member, the front member comprising an arc from a highest vertical position of the front member to a point at which the front member extends furthest along the bottom member, the front member comprising a substantially clear material to allow the full face of greeting cards held in the shadow box display to be viewed through the front member by a consumer without removing the greetings cards from the shadow box display.

32. The fixture of claim 4, wherein the back panel is disposed at a non-orthogonal angle to the first and second vertical side members to present the greeting card at an angle with respect to upper tier display.

33. The fixture of claim 1, further comprising at least one shadowbox display holder positioned generally above the upper tier display for displaying a greeting card, each shadowbox display holder comprising:

a first and a second vertical side member;

a bottom member coupled to the first and the second vertical side members; and a back panel coupled to the top member and the first and the second vertical side members;

a see-through front panel orthogonally coupled to at least one of the bottom member and the first and second vertical side members, wherein the front panel extends vertically upward to a height less than the back panel and the first and second vertical side members and extends horizontally across at least a portion of a distance between the first and second vertical side members.

34. The fixture of claim 33, wherein the back panel is disposed at a non-orthogonal angle to a vertical plane of the upper tier display to present the greeting card at an angle with respect to upper tier display.

35. A display fixture for the display of greeting cards, comprising:

an upper tier display;

a lower tier display positioned below the upper tier display; and a supporting structure supporting the upper and lower tier displays;

wherein each of the upper and lower tier displays comprises at least two horizontal rows of pockets configured to hold the greeting cards, the at least two rows of pockets comprising:

a top row; and a bottom row positioned below the top row and each other row of the at least two rows of pockets, wherein each row comprises a back panel extending upward in a substantially vertical manner, and wherein each pocket comprises a base extending outward from the respective tier in a substantially orthogonal manner and provides a bottom support for displaying greeting cards;

a card highlighter display removably attached along at least one of the rows of the pockets of the upper tier display and adjacent to certain pockets to highlight each of the greeting cards placed within the card highlighter display, the card highlighter display comprising:

a base providing a bottom support for displaying the greeting cards; and a back panel coupled substantially orthogonally to the card highlighter display base, wherein the card highlighter base extends outward from the upper tier to a distance greater than the base of the adjacent pockets, wherein the base of the card highlighter display is at substantially the same vertical position as the base for the adjacent pockets to display greeting cards in the adjacent pockets and the card highlighter display at substantially the same vertical position, wherein the back panel of the card highlighter display is positioned in front of the back panel of the row the card highlighter display is positioned along to display greeting cards in the card highlighter display in a position further from the back panel of the row than that of the greeting cards held within the row the card highlighter is positioned along, and wherein the card highlighter display replaces at least a portion of the pockets of at least one row of pockets of the upper tier display, and wherein the card highlighter display is configured to display the greeting cards placed within the card highlighter display in a full-facing manner to display the full face of each greeting card;

the pockets in the upper tier display configured to display a portion of the greeting cards in a full-facing manner to display the full face of each greeting card; and the pockets in the lower tier display, other than a bottom row of pockets in the lower tier display, configured to display another portion of the greeting cards in a partial-facing manner.

36. The fixture of claim 35, wherein the card highlighter display further comprises:

a back member; and two card dividers, wherein each card divider is coupled along a first vertical side to the back member and extends in a vertical direction from a bottom of the back member to a top of the back member and orthogonally outward from a vertical portion of the back member to provide a separation between greeting cards placed within the card highlighter display and the greeting cards held in the pockets of the row the card highlighter display is positioned along.

37. The fixture of claim 35, wherein the back member of the card highlighter display extends above the greeting cards placed within the card highlighter display and above back members for the pockets of the bottom row of the upper tier display not replaced by the card highlighter display.

38. The fixture of claim 35, wherein each row of the fixture further comprises a plurality of shams and wherein the card highlighter display is slidably inserted into at least one sham in one of the rows of the fixture.

* * * * *